US007712342B2

(12) United States Patent
Loughlin et al.

(10) Patent No.: US 7,712,342 B2
(45) Date of Patent: May 11, 2010

(54) TOOL OPERATED COMBINATION LOCK

(75) Inventors: Robert Loughlin, Stanton, NJ (US); John Loughlin, Lebanon, NJ (US); Arthur L. Arledge, Basking Ridge, NJ (US)

(73) Assignee: Stanton Concepts Inc., Stanton, NJ (US)

( * ) Notice: Subject to any disclaimer, the term of this patent is extended or adjusted under 35 U.S.C. 154(b) by 611 days.

(21) Appl. No.: 11/255,659

(22) Filed: Oct. 21, 2005

(65) Prior Publication Data

US 2006/0096343 A1 May 11, 2006

Related U.S. Application Data

(63) Continuation-in-part of application No. 11/186,698, filed on Jul. 21, 2005, and a continuation-in-part of application No. 10/968,691, filed on Oct. 19, 2004, now Pat. No. 7,021,092.

(60) Provisional application No. 60/590,201, filed on Jul. 22, 2004, provisional application No. 60/621,031, filed on Oct. 21, 2004.

(51) Int. Cl.
*E05B 19/20* (2006.01)
*E05B 29/00* (2006.01)

(52) U.S. Cl. ..... 70/366; 70/329; 70/332; 70/394; 70/395; 70/409; 70/454; 70/495

(58) Field of Classification Search ..... 70/303 A, 70/365, 366, 289, 290, 333 R, 394, 395, 399, 70/408, 409, 446, 329, 332, 453, 454, 495, 70/496; 33/539, 540; 340/5.6, 5.64, 5.67, 340/5.55, 5.73

See application file for complete search history.

(56) References Cited

U.S. PATENT DOCUMENTS 14,059 A 1/1856 Harrison, Jr.
18,169 A 9/1857 Yale (Continued)

FOREIGN PATENT DOCUMENTS

CN 590146 6/2004

OTHER PUBLICATIONS

Palos Sports, StopLock, Rotary dial combination school lock, www.palossports.com/store/proddetails.cfm/ItemID/1667/CategoryID/7081/SubCatID/0/file.htm.

www.locks4schools.com/stoplock.htm, Alsip, Ilinois, Jun. 30, 2004.

Cross Check Bolt Seal and Hydro Check Removal Tool, Tyden Brammall, 409 Hoosier Drive, Angola, IN 46703.

(Continued)

*Primary Examiner*—Lloyd A Gall
(74) *Attorney, Agent, or Firm*—Diehl Servilla LLC; Glen M. Diehl

(57) ABSTRACT

A process for opening a combination lock having a known opening sequence with a tool having a driven portion operable only upon receipt of an authorization, the process including associating the tool's driven portion with the lock such that the driven portion automatically calibrates with the lock irrespective of the initial position of the lock and authorizing the driven portion to proceed through the known lock opening sequence of a predetermined series of clockwise and counterclockwise rotations to unlock the lock. A method of opening a combination lock with a tool, the combination lock having an opening sequence consisting of clockwise and counterclockwise rotations of a non finger manipulable lock opening component, the method including mating the tool with the lock opening component and operating the tool to rotate the lock opening component through a series of clockwise and counterclockwise rotations corresponding to the opening sequence to unlock the lock.

19 Claims, 20 Drawing Sheets

U.S. PATENT DOCUMENTS

| | | | | | |
|---|---|---|---|---|---|
| 25,428 | A | | 9/1859 | Lyon | |
| 44,007 | A | | 8/1864 | Lorenz | |
| 44,757 | A | | 10/1864 | Thomson | |
| 53,096 | A | | 3/1866 | Ascherfeld | |
| 61,055 | A | | 1/1867 | Decker | |
| 81,203 | A | | 8/1868 | Pease | |
| 81,204 | A | | 8/1868 | Pease | |
| 98,917 | A | | 1/1870 | Brooks | |
| 100,402 | A | | 3/1870 | Hillebrand | |
| 104,038 | A | | 6/1870 | Kitson et al. | |
| 109,718 | A | | 11/1870 | Corbet et al. | |
| 122,082 | A | | 12/1871 | Van Tassel | |
| 177,814 | A | | 5/1876 | Delkescamp | |
| 206,528 | A | | 7/1878 | Bramble | |
| 210,844 | A | | 12/1878 | Ferret | |
| 221,595 | A | | 11/1879 | Mix | |
| 229,003 | A | | 6/1880 | Mason | |
| 248,835 | A | | 11/1881 | Adams | |
| 256,399 | A | | 4/1882 | Spielman | |
| 274,875 | A | | 3/1883 | Yoe | |
| 280,649 | A | | 7/1883 | Menzies | |
| 297,445 | A | | 4/1884 | Plumb | |
| 374,592 | A | | 12/1887 | Gilman | |
| 417,602 | A | | 12/1889 | Straubinger | |
| 418,884 | A | | 1/1890 | Bramble | |
| 502,307 | A | | 8/1893 | Lowrie | |
| 512,979 | A | | 1/1894 | Lowrie | |
| 534,653 | A | | 2/1895 | Lenhart et al. | |
| 549,951 | A | | 11/1895 | Belanger | |
| 621,391 | A | | 3/1899 | Turner | |
| 628,161 | A | | 7/1899 | Homman | |
| 686,882 | A | | 11/1901 | Ballou | |
| 837,295 | A | | 12/1906 | Fisher | |
| 858,264 | A | | 6/1907 | Daugherty | |
| 880,932 | A | | 3/1908 | Swoggers | |
| 912,773 | A | | 2/1909 | Augenbraun | |
| 948,853 | A | | 2/1910 | Gilroy | |
| 972,171 | A | | 10/1910 | Dupont | |
| 1,025,538 | A | | 5/1912 | Roche | |
| 1,092,474 | A | | 4/1914 | Carroll | |
| 1,222,082 | A | | 4/1917 | Descalles | |
| 1,284,655 | A | | 11/1918 | Greber | |
| 1,347,467 | A | | 7/1920 | Scott et al. | |
| 1,363,599 | A | | 12/1920 | Hull et al. | |
| 1,367,647 | A | | 2/1921 | Washburn | |
| 1,384,577 | A | | 7/1921 | Swan | |
| 1,401,030 | A | | 12/1921 | Ashkar | |
| 1,424,543 | A | | 8/1922 | Wiloch | |
| 1,426,978 | A | | 8/1922 | Gambino | |
| 1,469,233 | A | | 10/1923 | Messina et al. | |
| 1,520,902 | A | | 12/1924 | Junkunc | |
| 1,527,336 | A | | 2/1925 | Voda | |
| 1,618,997 | A | | 3/1927 | Radandt | |
| 1,659,433 | A | | 2/1928 | Kroll | |
| 1,665,990 | A | * | 4/1928 | Soley | 70/133 |
| 1,689,305 | A | | 10/1928 | Spano | |
| 1,712,476 | A | | 5/1929 | Coiro | |
| 1,718,723 | A | | 6/1929 | Williams | |
| 1,719,309 | A | | 7/1929 | Radosevic | |
| 1,755,521 | A | | 4/1930 | Smith | |
| 1,828,747 | A | | 10/1931 | Perry | |
| 1,835,317 | A | | 12/1931 | Miller | |
| 1,857,399 | A | | 5/1932 | Piagneri | |
| 1,867,689 | A | | 7/1932 | Van Leer | |
| 1,892,964 | A | | 1/1933 | Rainey | |
| 1,902,665 | A | | 3/1933 | Reinhold | |
| 2,001,262 | A | | 5/1935 | North | |
| 2,079,578 | A | | 5/1937 | Schlesinger et al. | |
| 2,116,965 | A | | 5/1938 | Schoorel et al. | |
| 2,138,003 | A | * | 11/1938 | Hamilton | 70/329 |
| 2,140,490 | A | | 12/1938 | Wise | |
| 2,159,291 | A | | 5/1939 | Quintal | |
| 2,163,121 | A | | 6/1939 | Holtzman | |
| 2,163,852 | A | | 6/1939 | Pond | |
| 2,179,045 | A | | 11/1939 | Lewis | |
| 2,185,899 | A | | 1/1940 | Nehls | |
| 2,248,695 | A | | 7/1941 | Bradshaw | |
| 2,319,753 | A | | 5/1943 | Smith et al. | |
| 2,362,999 | A | | 11/1944 | Hewitt | |
| 2,479,199 | A | | 8/1949 | Bennett et al. | |
| 2,488,986 | A | | 11/1949 | Richter | |
| 2,497,619 | A | | 2/1950 | Mass | |
| 2,508,302 | A | | 5/1950 | Stue | |
| 2,544,305 | A | | 3/1951 | Finke et al. | |
| 2,546,182 | A | | 3/1951 | Fenari | |
| 2,623,378 | A | | 12/1952 | Haver | |
| 2,655,805 | A | | 10/1953 | Fletcher | |
| 2,666,318 | A | | 1/1954 | Welch | |
| 2,686,447 | A | | 8/1954 | Vock et al. | |
| 2,770,998 | A | | 11/1956 | Schwartz | |
| 2,834,195 | A | | 5/1958 | Stackhouse | |
| 3,241,408 | A | | 3/1966 | McCauley | |
| 3,330,586 | A | | 7/1967 | Becker | |
| 3,363,500 | A | | 1/1968 | Simko | |
| 3,400,626 | A | | 9/1968 | Bergere | |
| 3,412,635 | A | | 11/1968 | Chmielewski | |
| 3,498,173 | A | | 3/1970 | Wright | |
| 3,546,906 | A | | 12/1970 | Yang | |
| 3,572,063 | A | | 3/1971 | Foote | |
| 3,581,530 | A | | 6/1971 | Raspadori | |
| 3,584,667 | A | | 6/1971 | Reiland | |
| 3,592,027 | A | | 7/1971 | Wako | |
| 3,702,551 | A | | 11/1972 | Blizard | |
| 3,750,431 | A | | 8/1973 | Atkinson | |
| 3,808,984 | A | | 5/1974 | Teleky | |
| 3,823,584 | A | | 7/1974 | Gill | |
| 3,837,189 | A | | 9/1974 | Atkinson | |
| 3,841,118 | A | | 10/1974 | Stone | |
| 3,874,258 | A | | 4/1975 | Semola et al. | |
| 3,952,559 | A | | 4/1976 | Atkinson | |
| 3,973,418 | A | | 8/1976 | Close | |
| 3,987,653 | A | | 10/1976 | Lyon et al. | |
| 4,006,660 | A | | 2/1977 | Yamamoto et al. | |
| 4,015,456 | A | | 4/1977 | Moberg | |
| 4,027,572 | A | | 6/1977 | Burge | |
| 4,066,195 | A | | 1/1978 | Dickler | |
| 4,070,879 | A | | 1/1978 | Thompson | |
| 4,073,165 | A | | 2/1978 | Grundstrom et al. | |
| 4,100,777 | A | * | 7/1978 | Fredon | 70/491 |
| 4,161,896 | A | | 7/1979 | Creed | |
| 4,170,918 | A | | 10/1979 | Burge | |
| 4,191,228 | A | | 3/1980 | Fenton | |
| RE30,243 | E | | 4/1980 | Oliver | |
| 4,211,128 | A | | 7/1980 | Plumer | |
| 4,216,664 | A | | 8/1980 | Slavinsky | |
| 4,280,726 | A | | 7/1981 | McCoag | |
| 4,325,240 | A | | 4/1982 | Gable | |
| 4,332,153 | A | | 6/1982 | Miles | |
| 4,351,171 | A | | 9/1982 | Tsui | |
| 4,433,563 | A | * | 2/1984 | Wilson | 70/446 |
| 4,483,164 | A | | 11/1984 | Nielsen, Jr. et al. | |
| 4,499,745 | A | | 2/1985 | Ricouard et al. | |
| 4,532,785 | A | | 8/1985 | Uyeda | |
| 4,557,122 | A | | 12/1985 | Hwang | |
| 4,557,124 | A | * | 12/1985 | Russ | 70/456 R |
| 4,655,062 | A | | 4/1987 | Kaufman | |
| 4,671,088 | A | | 6/1987 | Jeang | |
| 4,690,443 | A | | 9/1987 | Brammall | |
| 4,730,467 | A | | 3/1988 | Lebrecht | |
| 4,751,830 | A | | 6/1988 | Cheng | |
| 4,770,013 | A | | 9/1988 | Nakai | |
| 4,809,569 | A | | 3/1989 | Erb | |
| 4,823,566 | A | | 4/1989 | Patton | |
| 4,823,567 | A | | 4/1989 | Patton | |

| | | | | |
|---|---|---|---|---|
| 4,829,795 | A | 5/1989 | Taylor | |
| 4,838,052 | A | 6/1989 | Williams et al. | |
| 4,841,753 | A | 6/1989 | Patton | |
| 4,862,714 | A | 9/1989 | Taylor et al. | |
| 4,866,958 | A | 9/1989 | Bretl et al. | |
| 4,884,419 | A | 12/1989 | Ling | |
| 4,885,923 | A | 12/1989 | Nakai | |
| 4,901,057 | A | 2/1990 | Suneborn | |
| 4,905,490 | A * | 3/1990 | Wilson | 70/442 |
| 4,918,951 | A | 4/1990 | Kavizky | |
| 4,952,228 | A | 8/1990 | Taylor et al. | |
| 5,017,851 | A * | 5/1991 | Heinzman | 318/685 |
| 5,020,342 | A | 6/1991 | Doan et al. | |
| 5,033,279 | A | 7/1991 | Lebrecht | |
| 5,134,869 | A | 8/1992 | Gable | |
| 5,137,407 | A | 8/1992 | Yamamoto | |
| 5,140,317 | A | 8/1992 | Hyatt, Jr. et al. | |
| 5,184,491 | A | 2/1993 | Schittenhelm et al. | |
| 5,193,367 | A | 3/1993 | Ling | |
| 5,195,342 | A | 3/1993 | Werner | |
| 5,237,842 | A | 8/1993 | Rasch et al. | |
| 5,245,143 | A * | 9/1993 | James et al. | 200/43.08 |
| 5,279,190 | A | 1/1994 | Goss et al. | |
| 5,347,689 | A | 9/1994 | Georgopoulos et al. | |
| D352,886 | S | 11/1994 | Taylor | |
| 5,361,614 | A | 11/1994 | Metcalf | |
| 5,367,785 | A | 11/1994 | Benarroch | |
| 5,378,101 | A | 1/1995 | Olson et al. | |
| D360,125 | S | 7/1995 | Taylor | |
| 5,440,909 | A * | 8/1995 | Ely et al. | 70/395 |
| 5,485,734 | A | 1/1996 | Yang | |
| D370,618 | S | 6/1996 | Taylor | |
| 5,542,273 | A * | 8/1996 | Bednarz | 70/34 |
| 5,582,049 | A | 12/1996 | Mauer | |
| 5,666,831 | A | 9/1997 | Doros | |
| 5,678,436 | A | 10/1997 | Alexander | |
| 5,694,797 | A | 12/1997 | Kuo | |
| 5,715,709 | A | 2/1998 | Lai | |
| 5,732,989 | A | 3/1998 | Stevenson et al. | |
| 5,737,947 | A | 4/1998 | Ling | |
| 5,749,610 | A | 5/1998 | Brammall et al. | |
| 5,839,302 | A | 11/1998 | Chu | |
| 5,868,012 | A | 2/1999 | Chun-Te et al. | |
| 5,870,914 | A | 2/1999 | Dawson | |
| 5,878,604 | A | 3/1999 | Stone et al. | |
| 5,931,030 | A | 8/1999 | Chen | |
| 5,987,939 | A | 11/1999 | Pitisettakarn | |
| 6,047,575 | A | 4/2000 | Larson et al. | |
| 6,147,622 | A | 11/2000 | Fonea et al. | |
| 6,173,592 | B1 | 1/2001 | Yu | |
| 6,227,016 | B1 | 5/2001 | Yu | |
| 6,233,984 | B1 | 5/2001 | Blehi, III | |
| D450,232 | S | 11/2001 | Taylor et al. | |
| 6,378,344 | B1 * | 4/2002 | Gartner | 70/278.1 |
| 6,386,006 | B1 * | 5/2002 | DeWalch | 70/34 |
| 6,389,854 | B1 | 5/2002 | Huang | |
| 6,408,660 | B1 | 6/2002 | Lai | |
| 6,453,706 | B1 | 9/2002 | Chen | |
| 6,464,269 | B1 | 10/2002 | Wilhelm et al. | |
| 6,494,070 | B1 | 12/2002 | Moss et al. | |
| 6,508,086 | B2 | 1/2003 | Chen | |
| 6,508,089 | B1 | 1/2003 | Tsai | |
| 6,513,356 | B1 | 2/2003 | Yang | |
| 6,513,357 | B2 | 2/2003 | McCurry | |
| 6,516,643 | B1 | 2/2003 | Olshausen | |
| 6,539,761 | B2 | 4/2003 | Yang | |
| 6,546,763 | B1 | 4/2003 | Pielach | |
| 6,546,764 | B2 | 4/2003 | Segawa | |
| 6,584,819 | B1 | 7/2003 | Hung | |
| 6,598,434 | B2 | 7/2003 | Yang | |
| 6,604,393 | B2 | 8/2003 | Larsen et al. | |
| 6,708,534 | B1 | 3/2004 | Ruan | |
| 6,722,166 | B2 | 4/2004 | Skjellerup | |
| 6,725,692 | B2 | 4/2004 | Weinraub | |
| 6,729,166 | B1 | 5/2004 | Lai | |
| 6,739,796 | B1 | 5/2004 | Del Nero et al. | |
| 6,766,673 | B2 | 7/2004 | Gast et al. | |
| 6,843,080 | B1 | 1/2005 | Yu | |
| 6,848,283 | B1 | 2/2005 | Lin | |
| 6,860,125 | B1 | 3/2005 | Yu | |
| 7,021,092 | B2 | 4/2006 | Loughlin et al. | |
| 7,193,503 | B2 | 3/2007 | Fisher | |
| 2001/0039818 | A1 | 11/2001 | Jones et al. | |
| 2002/0088256 | A1 | 7/2002 | Taylor et al. | |
| 2002/0129628 | A1 | 9/2002 | Skalberg | |
| 2002/0139155 | A1 | 10/2002 | Franzen | |
| 2003/0089147 | A1 | 5/2003 | Yang | |
| 2004/0083782 | A1 | 5/2004 | Lantz | |
| 2004/0226323 | A1 | 11/2004 | Ling et al. | |
| 2005/0034492 | A1 | 2/2005 | Yu | |
| 2005/0039500 | A1 | 2/2005 | Yu | |
| 2005/0039501 | A1 | 2/2005 | Yu | |
| 2005/0044900 | A1 | 3/2005 | Yu | |
| 2005/0044901 | A1 | 3/2005 | Yu | |
| 2005/0044902 | A1 | 3/2005 | Yu | |
| 2005/0044903 | A1 | 3/2005 | Ling et al. | |
| 2005/0044909 | A1 * | 3/2005 | Lange | 70/278.1 |
| 2005/0235705 | A1 | 10/2005 | Ling et al. | |
| 2005/0235706 | A1 | 10/2005 | Ling et al. | |

OTHER PUBLICATIONS

E. J. Brooks Company, Reusable Trans-Lok Seal™, www.ejbrooks.com, Livingston, New Jersey, Apr. 13, 2003.

Mcgard Special Products Division, Innovative Security Solutions, The Intimidator, Orchard Park, New York, Revised Jun. 2002.

Tanner Corp., The Tanner Product Line, Security Fasteners, Tamper-Resistant Products, www.tannerbolt.com, Brooklyn, New York.

U.S. Appl. No. 60/443,331, filed Jan. 29, 2003.

Ordering Instructions for DuraCam gaming locks.

Keyless Combination Cam Lock Specification Sheet.

Nexgen by Medeco®, High Security Electronic Access Control for the Vending Industry, Medeco High Security Locks, An ASSA ABLOY Group Company.

Medeco High Securty Locks, Vending Products, NEXGEN—Electronic Vending Locks, www.medeco.com/products/products_detail_section_i.

Videx CyberLock® Information, www.videx.com/products/detail/cyberlock.html.

Mul-T-Lock, An ASSA ABLOY Group Company, www.multi-lock.com.

Ebay Sale Printout of Joseph L. Hall Safe Lock with Case and Dial NR, http://cgi.ebay.com/ws/eBayISAPI.dll?ViewItem=7307910193; pp. 1-10; Mar. 24, 2005.

Figure 7, Medeco Cylinder Product #60W65655T-219-26-XX, Medeco, P.O. Box 3075, 3625 Allegheny Drive, Salem, VA 24153-0330, reprinted in U.S. Appl. No. 60/621,031, p. 15, Oct. 21, 2004.

Figure 8, CCL "Keyless Cam Lock," #'s CK2113, CK3113 and CK4113, CCL Security Products, 301 West Hintz Road, Wheeling, IL 60090, reprinted in U.S. Appl. No. 60/621,031, p. 16, Mar. 24, 2004.

Figure 9, Medeco NexGen™, Medeco, P.O. Box 3075, 3625 Allegheny Drive, Salem, VA 24153-0330, reprinted in U.S. Appl. No. 60/621,031, p. 17, Mar. 24, 2004.

Figure 10, Videx CyberLock™, Videx, 1105 N.E. Circle Blvd., Corvallis, OR 97330, reprinted in U.S. Appl. No. 60/621,031, p. 18, Mar. 24, 2004.

Non-Final Office Action for U.S. Appl. No. 11/186,698, (Jun. 29, 2009), 9 pgs.

* cited by examiner 196
190a
196
190b
190c
190d
119
192a
106a
190e
192b
198
194
192c
106b
192d
106c
198
192e
106d
106e

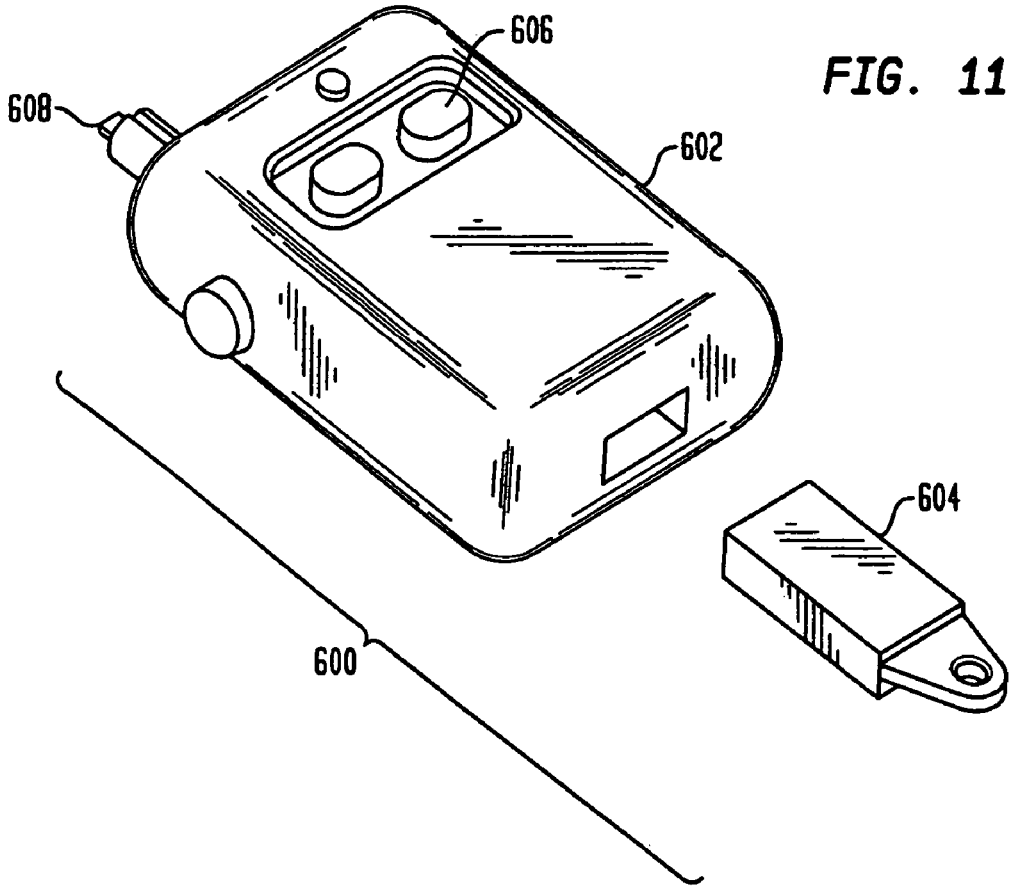
FIG. 11
FIG. 12
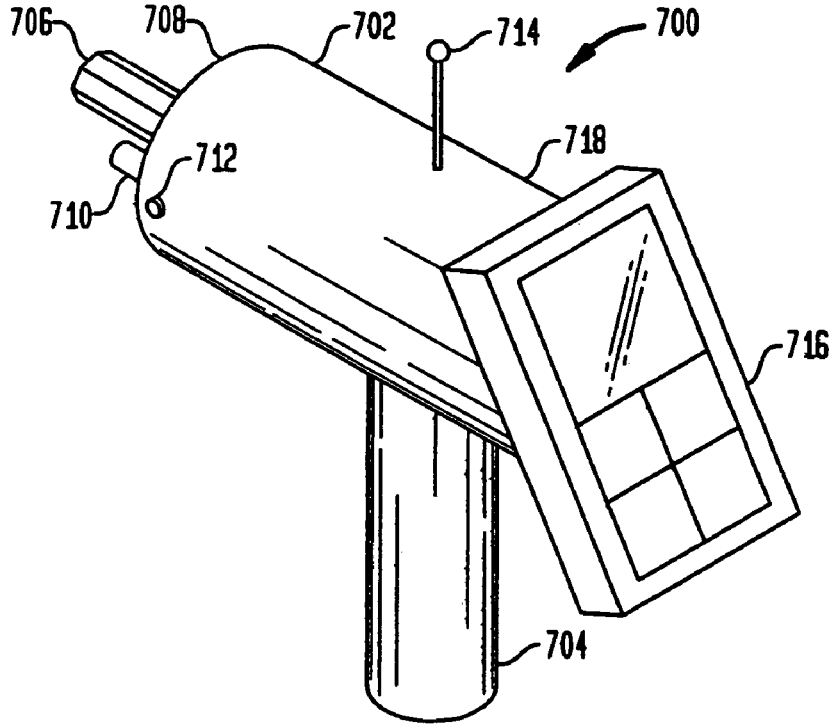

TOOL OPERATED COMBINATION LOCK

CROSS REFERENCE TO RELATED APPLICATIONS

This application is a continuation-in-part of U.S. patent application Ser. No. 11/186,698 filed Jul. 21, 2005 which claims the benefit of the filing dates of U.S. Provisional Patent Application No. 60/590,201 filed Jul. 22, 2004, and U.S. Provisional Patent Application No. 60/621,031 filed Oct. 21, 2004, and is also a continuation-in-part of U.S. application Ser. No. 10/968,691 filed Oct. 19, 2004. The disclosures of each of the preceding applications are hereby incorporated herein by reference.

BACKGROUND OF THE INVENTION

The present invention relates in general to rotatable shaft combination lock mechanisms suitable for use in, for example, doors, safes, or portable padlocks. Typically, such rotatable shaft combination lock mechanisms include a plurality of gated tumbler wheels, but may also include other mechanisms which are actuated by rotation.

Conventional locks utilizing lock mechanisms of the general class known as combination locks typically include three or more tumbler wheels which are loosely journaled in coaxial longitudinally spaced relation for rotation on a spindle or drive shaft within the lock housing, where the drive shaft is accessed through the wall of the housing. Most typically, an indexed and finger manipulable wheel mechanism, or dial, is positioned on the outer surface of the housing. The wheel mechanism may be utilized to provide the required rotations of the drive shaft and tumbler wheels to unlatch the lock.

The external dial typically provides the operator with means to manually manipulate the internal drive shaft and tumbler wheels in accordance with a known code, or combination. The proper manipulation of the dial results in the unlatching and unlocking of the lock. In the three-tumbler-wheel system commonly used in the art, the operator generally rotates the external dial in a clockwise direction through angular positions to a first desired point, commonly referenced by a numeral, then rotates the external dial in a counterclockwise direction to a second desired point, commonly referenced by a numeral, and finally rotates the external dial again in a clockwise direction to a third desired point, again commonly referenced by a numeral. Following this typical procedure, the lock mechanism is unlatched and the lock may be opened.

Existing combination lock mechanisms are designed to be human friendly by including the discussed externally readable and finger manipulable dial. Notwithstanding the external indexing, the tolerances required for unlatching conventional locks are left quite loose, to further ease use by average persons. In a typical combination lock operable by a finger manipulable dial, the locking mechanism clearances are such that a slight over or under rotation of the dial will not be fatal to operation of the lock. Rather, clearances are designed to account for slight errors in precision.

For example, if a conventional combination lock has the combination 10-22-17, the lock is typically designed to be opened when a user rotates the dial clockwise three turns to the indexed numeral 10, counterclockwise two turns to the indexed numeral 22, and again clockwise one turn to the indexed numeral 17. However, it is conventional that tolerances are built in the lock mechanism such that rotations may be permitted to be off several digits, and the lock will still open. As an example, using the combination lock with the combination of 10-22-17, rotational input of 10-21-17 will likely open the lock. In fact, each of the rotations may be ceased or stopped at a digit which is "off" by more than only one digit, for example an input of 8-20-19 will likely still open the lock, even though each of the stopping points is "off" by two indexed positions.

There are several reasons for this built in sloppiness. These reasons most often have to do with human limitations regarding to dexterity, memory, and patience, which are all interrelated in some ways.

Regarding dexterity, even the most dexterous of humans are only capable of a certain level of positioning accuracy. In a typical peripherally gated combination lock, the lock manufacturers place a single gate at a location on the periphery of each wheel. This gate is sized to accept a side bar when the correct combination is entered. However, to account for the relative lack of dexterity exhibited by human manipulation, the gate is often much larger than the width of the side bar. If the gates were sized to include only a slight tolerance with the side bar, the rotational accuracy for opening a lock would be too tight for typical human manipulation. Of course, some humans may still be able to manipulate the lock for at least one indexed number accurately, but it would likely take a tremendous amount of time, effort, and concentration. That time, effort, and concentration weighs against the patience of the person. Thus, locks have heretofore been manufactured with gates which allow for a large tolerance with the side bar.

Also, the person's memory may fade over the time required to enter the rotational inputs required to unlatch the lock. For example, again using the combination above, if a person had to enter exactly 10-22-17, and no inaccuracies were tolerated, the person would have to spin the dial clockwise three times and stop precisely on the 10 position. The person would then have to rotate the dial counterclockwise two times and stop precisely on the 22 position. The concentration required to stop precisely on the second position may cause the person to forget the third digit of the combination, or forget the number or direction of rotations required for the final number of the combination. Other memory based complications may also interfere, such as external distinctions. Lock manufacturers thus build in a level of sloppiness that permits quick manipulation of the combination lock, for example by permitting the lock to unlatch even if a user is "off" by several digits.

Regarding memory, most conventional combination locks include three wheels, requiring the user to memorize a three-number combination. An example is the 10-22-17 combination discussed. If, however, the number of tumbler wheels were increased, the number of digits in the combination would be increased proportionally. Although this would permit more secure locks, the limits of human memory have contributed in discouraging the use of large numbers of disks.

Presently, among the most complicated of conventional locks are those used on bank vaults. Such locks may include four tumbler wheels, requiring a user to remember a four-number combination. Manipulation of such a lock taxes the abilities of users. The additional tumbler wheel not only requires the user to remember an additional number, but also increases the number of rotations required to open the lock. In the four-disk example, a user would have to first rotate the external dial four times in a clockwise direction, three times in a counter clockwise direction, two times in a clockwise direction, and finally one time in a counterclockwise direction, for a total of ten rotations. This is a lot of turns for a person to count while still remembering the combination and blocking outside interferences. Only in the most secure locations, bank vaults, is this tolerated. Most conventional locks are of the three-disk variety.

It is estimated that present commercial locks of the three-disk variety comprise 85% of the market while four-disk locks make up the remaining 15%. The greatest number of disks known to have been attempted in a commercial product is five, by Joseph L. Hall of Cincinnati, Ohio, in the mid-1800s. It is believed that this lock was only used for a short period of time due to the problems associated with manipulating five disks. No locks are presently known to embody five or more disks. Heretofore, the beneficial increase in security offered by a lock with greater than four disks has been severely outweighed by the difficulties associated with manipulating such a lock.

In addition to the added security provided by heretofore unheard of disk numbers, combination locks of the present invention also feature numerous other improvements, as will be discussed. One such improvement is the provision of much tighter tolerances within each tumbler wheel. Whereas conventional locks allow for a loose fit between the peripheral gate and the side bar, locks constructed in accordance with the present invention permit much tighter tolerances. Other of these improvements include the provision of a propriety (or non-propriety) female interface within the body of the cylinder lock which may only be engaged by a tool and is not finger manipulable. Accordingly, there may be no external dial. There may also be no visible demarcations on the lock housing associated with the combination.

The tool operated lock of the present invention therefore solves the inherent problems associated with limited human dexterity, memory, and patience by providing for a combination lock mechanism which may be manipulated and opened by a tool, or by a human in conjunction with particular tools. The functional arrangement of, and interrelationship between, the lock and the tool provides for security features, flexibility, and control not previously available from conventional locks. The tool operated combination lock of the present invention generally operates under the principles known in the combination lock art, with the additions of tighter clearances, greater numbers of disks (or tumbler wheels), and other improvements that could not have been realized in a practical sense until the novel mating of the combination lock with the speed and precision of the motorized tool. Tools for use with such locks are also disclosed herein.

SUMMARY OF THE INVENTION

In accordance with one aspect of the invention, a combination lock may comprise a casing having a notch in an interior surface thereof, the casing having a longitudinal centerline, a drive shaft mounted along the longitudinal centerline of the casing, a drive disk driven by the drive shaft, the drive disk having a gate, at least five disks, each of the disks rotatable about the drive shaft upon a driving force initiated by the drive disk, each of the disks having a gate, a side bar adapted to be housed within the notch of the casing, the side bar adapted to exit the notch and enter the gates of the disks and the gate of the drive disk when the gates are rotated into alignment, a latch associated with the drive shaft, the latch rotatable between a locked position when the side bar is within the notch and an unlocked position when the sidebar is within the gates.

The combination lock may further comprise a mechanism to communicate with a tool adapted to engage the drive shaft of the lock to move the latch from the locked position to the unlocked position.

The communication mechanism may communicate information related to the identification of the combination lock.

The communication mechanism may be one of a radio frequency reference device, mote, contact memory button, optical bar code, alphanumeric designation, or magnetic strip.

The drive shaft may be housed within an outer housing.

The outer housing may provide no demarcations of rotational position of the drive shaft.

The drive shaft may be incapable of human manipulation.

The combination lock may further comprise a scrambler spring, the scrambler spring adapted to store energy upon rotation of the drive shaft and release the stored energy upon release of the drive shaft to rotate the drive shaft to a random position.

The combination lock may further comprise a registration component, the registration component adapted to mate with a corresponding registration component of a tool to provide the tool with a reference point for opening the lock.

In accordance with other aspects of the invention, a combination lock may comprise a lock core, the lock core comprising a plurality of rotatable disks and a drive shaft operable to rotate the disks, each of the disks having a gate, a side bar operative to enter the gates of the disks when the gates are rotated into alignment, a scrambler spring associated with the drive shaft, the scrambler spring operative to store potential energy when the drive shaft is rotated in a first direction, the scrambler spring releasing the potential energy by spinning the drive shaft in a second direction upon release of the drive shaft.

In accordance with still further aspects of the present invention, a system for locking and unlocking a component may comprise a lock adapted to lock a component, the lock capable of being opened by manipulation of a combination mechanism, the lock having a communication apparatus for communicating information related to the opening of the lock with a tool, a tool matable with the lock and adapted to open the lock by manipulation of the combination mechanism, the tool adapted to receive the communicated information related to the opening of the lock from the communication apparatus.

The communicated information may be the identification of the particular lock.

The communicated information may be the required degrees and directions of rotation required to open the combination lock.

The tool may further comprise a linking mechanism to link the tool electronically to a remote authority.

The tool may not operate to unlock the lock without authorization of the authority.

The tool may further comprise a location detection apparatus to determine the precise location of the tool, the remote authority adapted to authorize operation of the tool at least partially based on the precise location of the tool at the attempted time of operation.

The tool may further comprise at least one of a video camera, audio microphone, keypad, card reader, biometric device, or clock, wherein the authorization of the remote authority is at least partially based on information conveyed from the at least one of a video camera, audio microphone, keypad, card reader, biometric device, or clock.

The remote authority may record information related to the operation of the tool.

The tool may further comprise a tool registration element and the lock may further comprise a lock registration element, the tool registration element and the lock registration element adapted to mate such that the tool may be manipulated from a starting reference point.

In accordance with still further aspects of the present invention, a system for locking and unlocking may comprise a combination lock having a drive shaft adapted to be rotated in sequential clockwise and counterclockwise rotations in accordance with a predetermined pattern to open the lock, a tool adapted to couple directly with the drive shaft of the lock to provide the required clockwise and counterclockwise rotations necessary to open the lock.

The lock and the tool may communicate with each other electronically.

The system may further comprise a remote authority adapted to communicate with the tool, the remote authority capable of overseeing operation of the tool.

The drive shaft may be non finger manipulable.

The combination lock may further comprise an outer housing having an aperture, the drive shaft being located within the outer housing such that the coupling of the tool with the drive shaft occurs within the aperture.

In accordance with additional aspects of the present invention, a method of opening a combination lock with a tool may comprise associating a tool having a user interface with a combination lock, manipulating the user interface of the tool such that the tool rotates portions of the lock through predetermined angular rotations until the lock unlocks, wherein the step of associating a tool with a combination lock places a portion of the tool within internal portions of the combination lock.

The lock may further comprise an apparatus for communicating information and the tool may include an apparatus for receiving the communicated information.

The tool may further comprise a communication mechanism adapted to communicate with a remote authority.

The tool may require authorization of the remote authority before rotating portions of the lock in response to manipulation of the user interface.

The combination lock may further comprise a rotatable shaft and the step of associating a tool with a combination lock may associate the tool directly with the rotatable shaft.

In accordance with still further aspects of the present invention, a tool for opening combination locks may comprise a motor, a lock interface associated with the motor such that the motor may rotate the lock interface, the lock interface adapted to communicate with a non finger manipulable rotation mechanism of a lock, a motor controller, the motor controller adapted to control the direction and extent of rotational operation of the motor, a power supply, the power supply supplying power to the tool, and a user interface, the user interface communicating with the motor controller.

The lock interface may be adapted to directly communicate with a drive shaft of the lock.

The lock interface may be adapted to communicate with the non finger manipulable rotation mechanism of the lock located within an internal portion of the lock.

The motor and the power supply may be at least partially contained within a first housing.

The microprocessor may be associated with a second housing, the second housing adapted to communicate directly with the first housing.

The first and second housings may be separable.

The tool may further comprise a microprocessor and a sensor, the sensor adapted to obtain information, the microprocessor adapted to analyze the information received by the sensor, wherein the microprocessor communicates with the motor controller to permit or deny operation of the tool based on the received information.

The information may be one of information related to the location of the tool, information related to the user of the tool, information related to the combination lock, or temporal information.

The tool may further comprise an alignment mechanism adapted to mate with a reference associated with the lock to provide a reference point of rotation for the lock interface.

In yet a further aspect of the invention, a method of opening a plurality of locks with a single tool may comprise attaching a tool having a user interface to a non finger manipulable portion of a first lock, entering information pertaining to the first lock into the tool, wherein the tool may open the first lock, attaching the tool to a non finger manipulable portion of a second lock, entering information pertaining to the second lock into the tool, wherein the tool may open the second lock.

The step of entering information related to the lock may be conducted through the user interface.

The first lock and the tool may be adapted to communicate information to each other, the information being related to the opening of the first lock.

The tool may include a memory module adapted to store information relative to the opening of locks.

The step of entering information related to the first lock may be conducted via communication mechanisms between the first lock and the tool.

In still further aspects of the invention, means may be provided to manipulate the internal tumbler wheels or disks of a combination lock in accordance with the appropriate combination, which may be known or unknown to the operator, by a motor driven tool. The combination necessary to drive the tool in the directions and positions appropriate for the disks of a given lock may be provided by means of a signal; electronic, electromagnetic, optical, or otherwise, from a preferably secure identification source. The signal may be obtained from a radio frequency reference device (RFID), a "mote" (a new class of interactive microelectronic devices also commonly referred to as smart dust or wireless sensing networks), a contact memory button (CMB) (a non-powered read/write memory device capable of transferring data by contact), an optical bar code, a magnetic strip, or similar medium, as will be discussed further.

In other embodiments, the lock may be provided with an alphanumeric designator corresponding to the lock's opening sequence. The tool may be provided with an optional character recognition system which may then read the alphanumeric characters to associate the tool with the lock. This source may provide the necessary combination, unique identification, and/or history of activity for the lock, in addition to other information. Additionally, the signal itself may be encrypted.

Locks of the type disclosed herein may not possess any specific opening information, such as the combination for that lock or that class of locks. Rather, such information may be provided elsewhere, for example in a lookup table associated with the tool used to open the lock or a remote authority in communication with the tool.

The tool may function as instructed by the revealed combination or by means of a unique identification linked to a higher authority, which provides the combination for the particular lock. The communication link, or the tool, may provide the necessary combination, authorizations, audit trail, and systems management as determined by the requirements of the application.

While incorporating the above features, the tools utilized as part of this invention may be of several levels of sophistication. In an initial level, a "dumb" tool may provide simple, specific and perhaps proprietary, mechanical actions to release latches or cause the lock to function. In general, a "dumb" tool requires the thought process of a person to operate the tool to unlatch a lock.

Typically, a "dumb" tool requires the operator to enter the lock's combination, manually into a computerized motor device within the tool to cause the tool to drive the lock through the appropriate combination or the "dumb" tool may be driven completely manually. In a manual mode of operation, a user may associate an external drive wheel with a mating element of the lock. The external drive wheel may include gear reduction technology to ensure that large and imprecise movements by the operator are reduced to very fine and accurate inputs into the lock. In the automatic operation mode, the tool may incorporate security features, such as having a different actual turning process then the process entered by a user, as will be discussed.

A "dumb" tool may also include proprietary interfaces with the lock, such as male/female mechanical interfaces. Typically, the interface will be hidden within the body of the lock cylinder and will be incorporated into the proximal end of the drive shaft. Such features include drive shaft ends with non-geometric constructions, or unique or rare geometries such as stars, torx, or the like. Preferably, the interface is proprietary.

"Dumb" tools may also incorporate additional security features such as electromagnetic pulse (EMP) protection, due to its pure mechanical make-up, or the use of exotic and high strength materials designed to withstand foreseeable attacks.

In addition, the tool may incorporate a time clock allowing for only time-certain use.

In a second level of sophistication, a "not-so-dumb" tool may be provided. In addition to meeting the description of a "dumb" tool, the "not-so-dumb" tool may incorporate means to identify the particular lock intended to be opened, without any input from the operator. The means of identifying the lock may be a signal from the lock, such as electronic, electromagnetic, optical, or otherwise. As previously discussed, the signal may be obtained from an RFID, mote, CMB, optical bar code, magnetic strip or similar medium.

A "not-so-dumb" tool may also include added security features such as radio frequency (RF) tagging, optics, global positioning systems (GPS), cellular triangulation, or similar tracking means. Moreover, the tool may have a database incorporated within the tool to determine the combination of a lock based on the precise geographic position of the tool, the position obtained by GPS, RF tagging, cellular triangulation, or other means.

A "not-so-dumb tool" may also include a "lock out" mechanism to protect against unauthorized use. This "lock out" mechanism may be a simple mechanical key cylinder or an electro mechanical device that enables the tool to operate only after the satisfaction of requirements such as entry of specific personal identification numbers (pin), passwords, passcards, biometrics, human embedded identification devices, voice sampling, or other criteria.

In other aspects of the invention, the tool may not indicate that the required authorizations have been provided, and may be captured by the lock upon attempted use without user validation or may include features to make the tool inseparable from the lock.

In yet a higher level of sophistication, a "smart tool" may build on the description of the "not-so-dumb tool" by at least including provisions to communicate with a remote station to provide some or all of the functions identified with a "not-so-dumb tool." The central station may then monitor use of the tool and/or locks in real time, and may provide immediate security functions not available in the "not-so-dumb" tool, as is discussed further below. In the "smart tool," the audit trail may be captured at the remote station, rather than, or in addition to, a memory module within the tool itself.

The "smart tool" may include features which go beyond those comprehended by the "not-so-dumb tool." One such feature is video authorization, as is discussed further below.

Whether "dumb," "not-so-dumb," or "smart," the tool may interface to the lock drive shaft with a mating drive. The drive interface may be a standard element like hex, torx, or Phillips drives, or alternatively may comprise a unique pattern like McGard®, a traditional key blank (keyed in a particular manner), or other types of proprietary interfaces. The tool is preferably able to quickly rotate the drive shaft in small angular increments or steps precisely and repeatably in both clockwise and counterclockwise directions. The lock itself may include tighter clearances between the "side bar" or fence and the mechanisms on the tumbler wheels with which they operate, including gates, bumps, notches, holes, etc., as known in the art.

Each lock may include a unique identification number that can be read either manually and entered manually into the tool, as in a "dumb" tool, or read automatically by the tool via RF tagging, magnetic interfaces, optical scanning, motes, CMBs or the like, as in a "not-so-dumb" or "smart" tool. In the case of identification by the tool, such as bar codes or optical interfaces, the identification may be internal to the lock to prevent reading of the bar code data or optical interface by the tool operator. The tool may then communicate the information to the operator for his subsequent operation of the tool's motor driven lock opening mechanism. In a "not-so-dumb," the tool may include an "in-tool" database that communicates with the identification, recognizes the unique identification, and provides the tool's drive mechanism with the required combination sequence to open the lock. In a "smart" tool, the database may be external to the tool, in a location with which the tool may communicate, such as a central operating station.

The "smart tool" may have provisions such that the tool may be enabled only after the operator has been identified and qualified by the security system. This identification and qualification procedure may be conducted through a pin number, a password, a passkey, biometrics, human embedded identification devices or other devices. Video images may also be utilized. Once enabled, the "smart tool" may obtain the unique identification number of the lock and request the code sequence (combination) required to open the lock from the remote database. The link from the tool to the remote database may use existing wired or wireless technology such as cellular, radio, satellite, wired landlines, or other means (the wired lines preferably including provisions within the tool for connection with standard telephone lines, cable lines, local area network lines, or the like for remote communication). At the remote database a complete audit trail could be maintained including location by GPS, cellular triangulation, RF tagging, manual input based on video capture, or the like. Discovery of theft or fraudulent use could result in a disabling lockout of the tool, capture of the tool, or another response as appropriate. All communications between the tool and the remote database may be encrypted for security purposes.

In other aspects of the invention, the lock itself may be hard-wired to a communication system for communicating with the remote station. A lock contained in a door of a typical office may include provisions for communicating operation times to a remote database via telephone line hard-wired directly into the lock. Operation events of the lock may then be monitored.

Combination lock mechanisms of the present invention may also incorporate an internal blocking element such as a miniature solenoid that is activated by the tool. In preferred embodiments, the combination lock mechanism is preferably in a blocked state at default, such that at least one of the internal disks cannot rotate. The tool may include a communication capability such that the tool and the lock, also provided with a communication capability, may go through an electronic "hand shake." Once the lock recognizes the tool as being proper, the solenoid may be energized and moved to allow full rotation of the lock. Power for this energizing may come from a battery within the lock, a hard-wired electrical circuit within the lock, or from the tool itself.

Embodiments of locks suited for the present invention may include locks applied to doors of all sorts, security cabinets and containers, trucking/railway containers, safes or vaults, and similar fixed structures. The same teachings may also be applied to portable locking devices (padlocks) of various configurations such as U-shackle style, straight shackle style, hidden shackle style, or any other portable locking devices. These various embodiments may be used wherever the popular key function or externally manipulated combination mechanisms have been the lock of choice, such as in perimeter securement, vending machines, trucking/railway/intermodal containers, luggage, lockers, etc. In addition, the inventive locks have inherent advantages that facilitate use in hostile environments, or in situations of infrequent use. For example, the lock mechanism itself is preferably not exposed to the elements as are externally exposed keyed cylinders. In addition, o-rings or other protective barriers may be employed to limit debris from entering the lock mechanism.

In accordance with other aspects of the invention, "dumb locks" may include purely passive locks with no means of communication with a tool or no means for independent power. Such "dumb locks" may, conversely, include means to communicate with the operator of a tool, such as a branded serial number or other identification number. These "dumb locks" may therefore be used with "dumb tools." A "smart lock" may include provisions to communicate with a tool, such that the tool may identify the lock, for example in the case of a "smart tool" or "no so smart tool." The "smart lock" may also include means to store data within the lock, as is discussed below.

In accordance with further aspects of the present invention, a process for opening a combination lock having a known opening sequence with a tool having a driven portion, the driven portion being operable only upon receipt of an authorization, may comprise associating the driven portion of the tool with the lock such that the driven portion of the tool automatically calibrates with the lock, and authorizing the driven portion of the tool to proceed through the known lock opening sequence comprising a predetermined series of clockwise and counterclockwise rotations to unlock the lock.

The process may further comprise reading an identification sequence associated with the lock, entering the identification sequence of the lock into the tool, and identifying the known lock opening sequence based on the identification sequence read from the lock.

The process may further comprise transmitting identification information associated with one of the lock and user to a remote authority. If so provided, the process may further comprise receiving a lock opening sequence from the remote authority based on the identification sequence read from the lock.

The step of authorizing the driven portion of the tool may be based on at least one element selected from the group consisting of: biometric data of a user, pass codes provided by a user, geographic location of the tool, temporal considerations, identification sequence associated with the lock, and acceptance of a signal.

In accordance with further aspects of the present invention, a tool for opening a combination lock having a non-finger manipulable interface may comprise a lock interface adapted to rotate in lock opening sequences of alternating clockwise and counterclockwise rotations, the lock interface adapted to communicate with the non-finger manipulable rotation mechanism of the lock, a motor adapted to drive the lock interface to rotate in clockwise and counterclockwise rotations, a motor controller adapted to control operation of the motor, and a user interface, the user interface communicating with the motor controller.

The tool may be operable to receive a lock identification number entered into the user interface. The tool may further include a memory module containing cross-references between the lock identification number and the lock opening sequence.

The tool may further include a biometric data reception port. The may only be operable upon entry of preauthorized biometric data into the biometric data reception port.

The tool may further include a location detection element, the location detection element adapted to identify the geographic location of the tool. The tool may be operable within certain geographic locations identified by the location detection element. The lock interface may be responsive to the location detection element so as to select the opening sequence based on the geographic location of the tool.

The tool may be operable only upon a proper input into the user interface. The proper input may be one of an identification signal, biometric data of a user, or a user identification number.

In accordance with still further aspects of the present invention providing for a method of opening a combination lock with a tool, the combination lock having an opening sequence consisting of clockwise and counterclockwise rotations of a non finger manipulable lock opening component, the method may comprise mating the tool with the lock opening component and operating the tool to rotate the non finger manipulable lock opening component through a series of clockwise and counterclockwise rotations corresponding to the opening sequence to unlock the lock.

The lock may further comprise a latch and the method may further comprise the step of rotating the tool to unlatch the latch.

The method may further comprising the step of reading a lock identification sequence from the lock. The method may further comprise the step of associating the lock identification sequence with the lock opening sequence. The step of associating may be conducted at a remote authority.

The method may further comprise recording the opening event.

The step of rotating may only be conducted following authorization. Authorization may be based on factors selected from the group consisting of biometric data of a user, personal identification number of a user, a lock identification sequence, temporal considerations, geographic location of the tool at time of operation, approval of a remote authority, and acceptance of a signal. The authorization may be obtained from a remote authority.

In accordance with yet another aspect of the present invention, a method of determining the opening sequence of a combination lock in which a combination lock core is disassociated with from a housing and exposed, the combination lock core having at least two peripherally gated disks aligned in series, where each of the disks has a gate and each of the disks is driven sequentially by either a drive disk or the preceding disk, may comprise the steps of rotating the drive disk in a first direction through at least a number of rotations equal to the number of disks contained within the lock to a first reference point where the gate of the first disk is in an opening position, recording the first reference point, rotating the drive disk in a second direction through a number of rotations equal to that of the number of disks contained within the lock minus one, continuing to rotate the drive disk in the second direction to a second reference point where the gate of the second disk is in an opening position aligned with the gate of the first disk, and recording the complete angle of rotation in the second direction required to reach the second reference point from the first reference point.

The combination lock may have at least a third peripherally gated disk aligned with the at least two peripherally gated disks, the third disk having a gate, the method further comprising the steps of rotating the drive disk in the first direction through a number of rotations equal to that of the number of disks contained within the lock minus two, continuing to rotate the drive disk in the first direction to a third reference point where the gate of the third disk is in an opening position aligned with the gates of the first disk and second disk, and recording the complete angle of rotation in the first direction required to reach the third reference point from the second reference point.

The combination lock may have at least a fourth peripherally gated disk aligned with the at least two peripherally gated disks and the third peripherally gated disk, the fourth disk having a gate, the method further comprising the steps of rotating the drive disk in the second direction through a number of rotations equal to that of the number of disks contained within the lock minus three, continuing to rotate the drive disk in the second direction to a fourth reference point where the gate of the fourth disk is in an opening position aligned with the gates of the first disk, second disk, and third disk, and recording the complete angle of rotation in the second direction required to reach the fourth reference point from the third reference point.

The lock may have a total of six peripherally gated disks and the method may further comprise rotating the drive disk in the first direction through two rotations, continuing to rotate the drive disk in the first direction to a fifth reference point where the gate of the fifth disk is in an opening position aligned with the gates of the first disk, second disk, third disk, and fourth disk, recording the complete angle of rotation in the first direction required to reach the fifth reference point from the fourth reference point, rotating the drive disk in the second direction to a sixth reference point where the gate of the drive disk is in an opening position aligned with the gates of the first disk, second disk, third disk, fourth disk, and fifth disk, and recording the complete angle of rotation in the second direction required to reach the sixth reference point from the fifth reference point.

BRIEF DESCRIPTION OF THE FIGURES

The subject matter regarded as the invention is particularly pointed out and distinctly claimed in the concluding portion of the specification. The invention, however, both as to organization and method of operation, together with features, objects, and advantages thereof will be or become apparent to one with skill in the art upon reference to the following detailed description when read with the accompanying drawings. It is intended that any additional organizations, methods of operation, features, objects or advantages ascertained by one skilled in the art be included within this description, be within the scope of the present invention, and be protected by the accompanying claims.

In regard to the drawings,

FIG. 11 is a perspective view of a multi-part tool in accordance with another embodiment of the present invention;

FIG. 12 is a perspective view of a tool in accordance with a further embodiment of the present invention;

DETAILED DESCRIPTION

Figure 1:
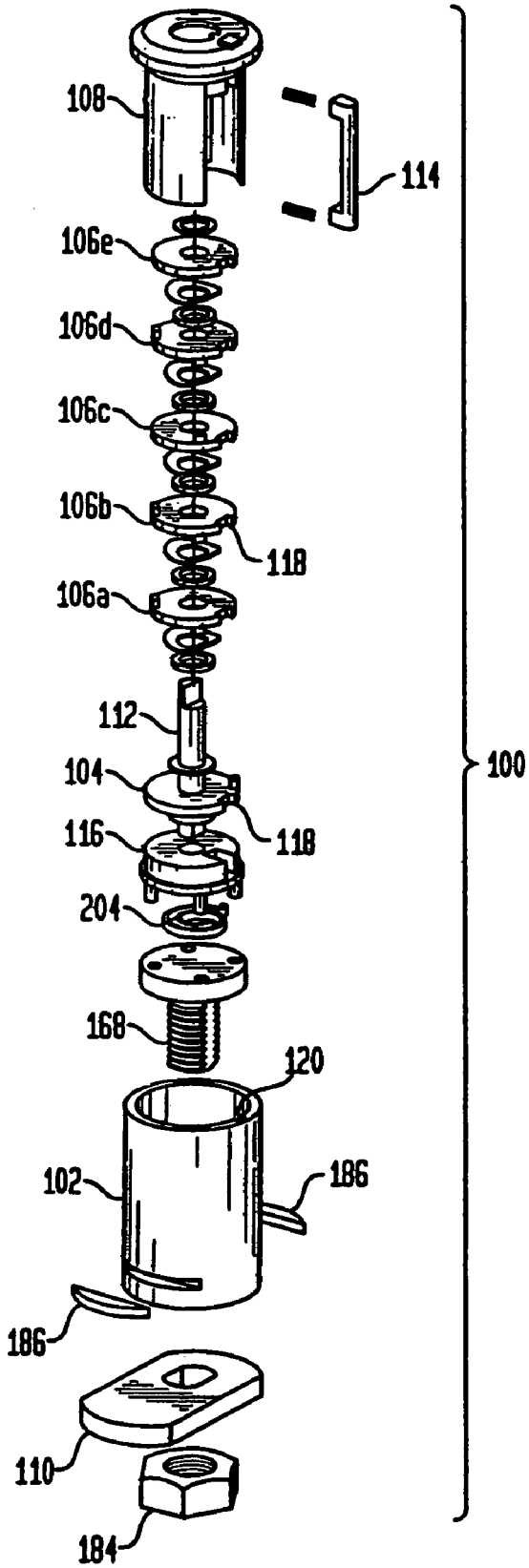
FIG. 1 is an exploded perspective view of a combination lock in accordance with one embodiment of the present invention.

In describing the preferred embodiments of the subject matter illustrated and to be described with respect to the drawings, specific terminology will be resorted to for the sake of clarity. However, the invention is not intended to be limited to the specific terms so selected and it is to be understood that each specific term includes all technical equivalents which operate in a similar manner to accomplish a similar purpose.

Aspects of the present invention provide means to manipulate the internal tumbler wheels or disks of a combination lock in accordance with the appropriate combination, which may be known or unknown to the operator, by means of a motor driven tool. In this regard, aspects of the present invention include the provision of novel manipulation means of the internal disks, preferably by means of a motor driven tool. The combination necessary to drive the tool in the directions and positions appropriate for the disks of a given lock may be provided by means of a signal; electronic, electromagnetic, optical, or otherwise, from a preferably secure identification source. The signal may be obtained from a radio frequency reference device (RFID), a "mote" (a new class of interactive microelectronic devices also commonly referred to as smart dust or wireless sensing networks), a contact memory button (CMB) (a non-powered read/write memory device capable of transferring data by contact), an optical bar code, a magnetic strip, or similar medium. In other embodiments, the lock may be provided with an alphanumeric designator corresponding to the lock's opening sequence. The tool may be provided with an optional character recognition system which may then read the alphanumeric characters to associate the tool with the lock. This source may provide the necessary combination, unique identification, and/or history of activity for the lock, in addition to other information. Additionally, the signal itself may be encrypted.

One feature of locks of the type disclosed herein is that the locks may not possess any specific opening information, such as the combination for that lock or that class of locks. Rather, such information may be provided elsewhere, for example in a lookup table associated with the tool used to open the lock or a remote authority in communication with the tool. As such, even if the lock is disassembled and analyzed, it would only potentially reveal the disk configuration for that particular lock, and not others of the same type. In addition, such acts would be destructive and would leave evidence of tampering.

The tool may function as instructed by the revealed combination or by means of a unique identification linked to a higher authority, which provides the combination for the particular lock. The communication link, or the tool, may provide the necessary combination, authorizations, audit trail, and systems management as determined by the requirements of the application.

While incorporating the above features, the tools utilized as part of this invention may be of several levels of sophistication. In an initial level, a "dumb" tool may provide simple, specific and perhaps proprietary, mechanical actions to release latches or cause the lock to function. In general, a "dumb" tool requires the thought process of a person to operate the tool to unlatch a lock.

Typically, a "dumb" tool requires the operator to enter the lock's combination, manually into a computerized motor device within the tool to cause the tool to drive the lock through the appropriate combination or the "dumb" tool may be driven completely manually. In regard to automatic operation, the operator may enter the required combination, such as the 10-22-17 example discussed above into a keypad associated with the tool. The tool may then manipulate the cylinder lock through the 10-22-17 sequence to open the lock. Preferably, there are no external markings on the lock housing to identify the numerical rotation stopping points. Rather, the tool itself incorporates means for calibration.

In the manual mode of operation, a user may associate an external drive wheel with a mating element of the lock. The external drive wheel may include gear reduction technology to ensure that large and imprecise movements by the operator are reduced to very fine and accurate inputs into the lock. Such devices are known in the industry. In the automatic operation mode, the tool may incorporate security features, such as having a different actual turning process than the process entered by a user. For example, a user may enter a certain combination into the tool, such as the 10-17-22 combination, but the tool may use that combination in accordance with a look-up table to determine the actual combination that will open the particular lock, which is preferably a combination completely different from the initial combination entered by the user. In a preferred embodiment, a user enters a lock identification number rather than a combination into the tool. The tool then looks up the lock's combination in accordance with a programmed look-up chart, internal to the tool and completely unknown to the user.

A "dumb" tool may also include proprietary interfaces with the lock, such as male/female mechanical interfaces. Typically, the interface will be hidden within the body of the lock cylinder and will be incorporated into the proximal end of the drive shaft. Such features include drive shaft ends with non-geometric constructions, or unique or rare geometries such as stars, torx, or the like. Preferably, the interface is proprietary.

"Dumb" tools may also incorporate additional security features such as electromagnetic pulse (EMP) protection, due to its pure mechanical make-up, or the use of exotic and high strength materials designed to withstand foreseeable attacks.

In addition, the tool may incorporate a time clock allowing for only time-certain use. For example, a particular tool may only be operable at certain times. Such a tool may be programmed to operate only during a person's shift, for example between the hours of 8:00 a.m. and 5:00 p.m. Alternatively, a tool may operate for a particular time period following entry of an access code or other authorization provision. This time period may be programmed to any length, such as 15 minutes or one day. The time clock may not be a conventional clock with hours and minutes displayed, but may be a simple countdown timer activated by the entry of an access code or other authorization. Any such time-certain operation may be identified as a temporal consideration.

In a second level of sophistication, a "not-so-dumb" tool may be provided. In addition to meeting the description of a "dumb" tool above, the "not-so-dumb" tool may incorporate means to identify the particular lock intended to be opened, without any input from the operator. In essence, therefore, the operator merely mates the tool with the lock and the tool determines the correct combination to open the lock based on identifying characteristics read or otherwise obtained from the lock itself. The means of identifying the lock may be a signal from the lock, such as electronic, electromagnetic, optical, or otherwise. As previously discussed, the signal may be obtained from an RFID, mote, CMB, optical bar code, magnetic strip or similar medium.

A "not-so-dumb" tool may also include added security features such as radio frequency (RF) tagging, optics, global positioning systems (GPS), cellular triangulation, or similar tracking means. For example, if the tool were moved outside of a designated area, the tool may be automatically disabled and/or flagged for later identification of the activity by system management.

Moreover, the tool may have a database incorporated within the tool to determine the combination of a lock based on the precise geographic position of the tool, the position obtained by GPS, RF tagging, cellular triangulation, or other means. For example, a particular user may have five locks located at different locations. The tool may have features built in, such as through GPS, cellular triangulation, RFID, or the like, by which the tool "knows" its precise geographic location. If the tool is activated at any one of the five locations, a look-up table within the tool may identify the correct combination for that particular lock, and may thus proceed to open the lock based on such data.

A "not-so-dumb tool" may also include a "lock out" mechanism to protect against unauthorized use. This "lock out" mechanism may be a simple mechanical key cylinder or an electro mechanical device that enables the tool to operate only after the satisfaction of requirements such as entry of specific personal identification numbers (pin), passwords, passcards, biometrics, human embedded identification devices, voice sampling, or other criteria. In this regard, the operator may be required to provide such validation means for the tool to operate. The tool may then operate indefinitely, or for a predetermined period of time. Other means of validation or authorization may be provided, such as proximity means. In this regard, a container may include a specific identifying feature with the container itself, such as an RF tag. The tool may be able to read this tag and identify the container. A lock external to the container may then have an opening sequence known by the tool in accordance with a look-up chart, preferably one capable of being modified depending on which particular lock is placed on which container. The tool may then open the lock. In essence, this embodiment of the invention is similar to one in which the tool identifies the lock, but replaces that identification for an identification of the container itself, not the lock. In this regard, one container may be provided from time to time with different locks, thus bolstering the security of the container.

In other aspects of the invention, the tool may not indicate that the required authorizations have been provided, and may be captured by the lock upon attempted use without user validation or may include features to make the tool inseparable from the lock.

In yet a higher level of sophistication, a "smart tool" may build on the description of the "not-so-dumb tool" by at least including provisions to communicate with a remote station to provide some or all of the functions identified with a "not-so-dumb tool." In this regard, the central station may then monitor use of the tool and/or locks in real time, and may provide immediate security functions not available in the "not-so-dumb" tool, such as immediate shutdown of all tool functioning upon a breach of security. In the "smart tool," the audit trail may be captured at the remote station, rather than, or in addition to, a memory module within the tool itself.

Because of the unique capabilities permitted by use of a remote station, the "smart tool" may include features which go beyond those comprehended by the "not-so-dumb tool." One such feature is video authorization. Video authorization may produce an image of the individual attempting to use the tool, the video image being produced at a remote station. A supervisor at the station may authorize the tool's use upon confirmation of the individuals security clearance based at least partially on the video observation. This video observation may also be utilized to ensure that the operator is not acting under threat or duress. Of course, audio or other means of validation may be layered with the video. Once validated, the tool may receive an authorization signal to allow its use to unlock the passive lock.

Whether "dumb," "not-so-dumb," or "smart," the tool may interface to the lock drive shaft with a mating drive. The drive interface may be a standard element like hex, torx, or Phillips drives, or alternatively may comprise a unique pattern like McGard®, a traditional key blank (keyed in a particular manner), or other types of proprietary interfaces (McGard® is a registered trademark of McGard Inc., 848 Kensington Avenue, Buffalo, N.Y. 14215). The tool is preferably able to quickly rotate the drive shaft in small angular increments or steps precisely and repeatably in both clockwise and counterclockwise directions. These features provide greatly enhanced performance from the traditional multiple tumbler wheel combination mechanisms requiring manual manipulation of external drive elements. These features also include significant improvement in the potential security provided. For example, because the tool's motor function is computer driven, and may incorporate more precise movement than capable by a human in a manual lock, the lock itself may include tighter clearances between the "side bar" or fence and the mechanisms on the tumbler wheels with which they operate, including gates, bumps, notches, holes, etc., as known in the art. Thus, the security against attempted opening via guessed codes (combinations) by humans is increased as is that against surreptitious attack. Because there is no need to facilitate direct human operation, it is envisioned that a lock mechanism cylinder of the present invention may be reduced to well below ¾" diameter or smaller, using presently available materials and known technologies. Locks may also be larger than ¾" diameter if so desired.

Each lock may include a unique identification number that can be read either manually and entered manually into the tool, as in a "dumb" tool, or read automatically by the tool via RF tagging, magnetic interfaces, optical scanning, motes, CMBs or the like, as in a "not-so-dumb" or "smart" tool. In the case of identification by the tool, such as bar codes or optical interfaces, the identification may be internal to the lock to prevent reading of the bar code data or optical interface by the tool operator. The tool may then communicate the information to the operator for his subsequent operation of the tool's motor driven lock opening mechanism. In a "not-so-dumb," the tool may include an "in-tool" database that communicates with the identification, recognizes the unique identification, and provides the tool's drive mechanism with the required combination sequence to open the lock. In a "smart" tool, the database may be external to the tool, in a location with which the tool may communicate, such as a central operating station.

The "smart tool" may have provisions such that the tool may be enabled only after the operator has been identified and qualified by the security system. This identification and qualification procedure may be conducted through a pin number, a password, a passkey, biometrics, human embedded identification devices or other devices. Videos images may also be utilized. Once enabled, the "smart tool" may obtain the unique identification number of the lock and request the code sequence (combination) required to open the lock from the remote database. The link from the tool to the remote database may use existing wired or wireless technology such as cellular, radio, satellite, wired landlines, or other means (the wired lines preferably including provisions within the tool for connection with standard telephone lines, cable lines, local area network lines, or the like for remote communication). At the remote database a complete audit trail could be maintained including location by GPS, cellular triangulation, RF tagging, manual input based on video capture, or the like. Discovery of theft or fraudulent use could result in a disabling lockout of the tool, capture of the tool, or another response as appropriate. All communications between the tool and the remote database may be encrypted for security purposes.

In other aspects of the invention, the lock itself may be hard-wired to a communication system for communicating with the remote station. For example, a lock contained in a door of a typical office may include provisions for communicating operation times to a remote database via telephone line hard-wired directly into the lock. Operation events of the lock may then be monitored.

Combination lock mechanisms of the present invention may also incorporate an internal blocking element such as a miniature solenoid that is activated by the tool. In preferred embodiments, the combination lock mechanism is preferably in a blocked state at default, such that at least one of the internal disks cannot rotate. The tool may therefore include a communication capability such that the tool and the lock, also provided with a communication capability, may go through an electronic "hand shake". Once the lock recognizes the tool as being proper, the solenoid may be energized and moved to allow full rotation of the lock. Power for this energizing may come from a battery within the lock, a hard-wired electrical circuit within the lock, or from the tool itself.

This technology, where a lock may go through a "hand shake" routine with a tool, is similar to technology incorporated into existing locks, such as those incorporated in Mul-T-Lock®'s Interactive® CLIQ® lock, Abloy's® SmartDisc lock, Medeco's® NEXGEN® locks, and Videx's® Ciber-Lock lock. Mul-T-Lock® and Interactive® are registered trademarks of Mul-T-Lock Limited Corp. Israel, Mul-T-Lock Park, Haazmant Boulevard, Yavine, Israel. CLIQ® is a registered trademark of ASSA ABLOY AB Corporation Sweden, P.O. Box 70340 S-10723, Stockholm, Sweden. ABLOY® is a registered trademark of ABLOY SECURITY LTD OY Corporation, Finland, Rajasampaaranta 2, SF-00560, Helsinki, Finland. Medeco® and NEXGEN® are registered trademarks of Medeco Security Locks, Inc. Corporation Virginia, P.O. Box 3075, Salem, Va. 24153. Videx® is a registered trademark of Videx, Inc. Corporation Oregon, 1105 N.E. Circle Blvd., Corvallis, Oreg. 97330-4285.

These products generally incorporate a processor and a blocking element in the lock cylinder that can be unlocked only after a successful digital handshake with a tool or key.

It will therefore be appreciated that in accordance with certain aspects of the invention, well-known, reliable, cost effective multiple disk combination locking mechanism may be utilized to provide a secure lock for various applications. This basic mechanism has been in common use for more than one hundred years, relying on manual manipulation of an external dial interface. This known concept requires the operator to know the appropriate sequence of manipulations or combination to cause the lock to open. However, the general concept has several major flaws that reveal themselves as the level of desired security increases.

One such flaw is a security flaw, which is the dependence on the maintenance of the secrecy of the combination. It will be appreciated that in a conventional lock, once an individual is aware of the combination, that individual may compromise the security of the lock, either intentionally or unintentionally, by permitting others to become aware of the combination. Another flaw is any one operational flaw, namely, the requirement that the operator know the secret combination. Obviously, if the operator does not know the combination, the operator may not be able to unlock the lock. Other important flaws involve the requirements for reasonable environmental operating conditions, such as sufficient lighting and time to perform the required functions. The operator's dexterity and mental capacity may also come into play, as conventional locks may be difficult to open for those with impaired physical abilities or limited mental capacity.

In the preferred embodiment of the present invention, the combination mechanism is simple, the interface with the tool is simple, the encrypted identity of the lock is readily available to the tool, and the tool provides the appropriate manipulation instructions to the motor driven interface which causes the disks to be arranged in the unlocked position to open the lock. The operator may not, and preferably should not, know the lock combination. In this preferred embodiment, the only function of the operator is to provide the means to authorize the tool's functioning (if incorporated) and to align and hold the tool in proper relationship with the lock for the functioning to occur.

Embodiments of locks suited for the present invention may include locks applied to doors of all sorts, security cabinets and containers, trucking/railway containers, safes or vaults, and similar fixed structures. The same teachings may also be applied to portable locking devices (padlocks) of various configurations such as U-shackle style, straight shackle style, hidden shackle style, or any other portable locking devices. These various embodiments may be used wherever the popular key function or externally manipulated combination mechanisms have been the lock of choice, such as in perimeter securement, vending machines, trucking/railway/intermodal containers, luggage, lockers, etc. In addition, the inventive locks have inherent advantages that facilitate use in hostile environments, or in situations of infrequent use. For example, the lock mechanism itself is preferably not exposed to the elements as are externally exposed keyed cylinders. In addition, o-rings or other protective barriers may be employed to limit debris from entering the lock mechanism.

In accordance with other aspects of the invention, "dumb locks" may include purely passive locks with no means of communication with a tool or no means for independent power. Such "dumb locks" may, conversely, include means to communicate with the operator of a tool, such as a branded serial number or other identification number. These "dumb locks" may therefore be used with "dumb tools." A "smart lock" may include provisions to communicate with a tool, such that the tool may identify the lock, for example in the case of a "smart tool" or "no so smart tool." The "smart lock" may also include means to store data within the lock, such as with CMBs. The CMBs may store data communicated from the tool, such as the identity of the operator operating the tool or the geographic location of the lock at the time of opening. The CMBs may also store data directly obtained from the lock itself, such as the time the lock was opened and closed or the identification of the tool with which it was opened.

In practice, the tool operated combination lock generally operates under the principles known in the combination lock art, with the additions of tighter clearances, greater numbers of disks, and other improvements that could not have been realized in a practical sense until the novel mating of the combination lock with the speed and precision of the motorized tool disclosed herein.

It is contemplated that the tool operated combination lock of the present invention may be compatible with existing and commonly used lock hardware, including changeable, removable core, and keyed cylinders, such as the locks produced by Medeco Security Locks, Inc, 3625 Alleghany Drive, Salem, Va. Such existing hardware is widely used in access control, transit, utility, vending, pay telephone, parking, alarm, safe and perimeter control applications. In order to be adaptable for use most effectively with existing hardware, the preferred tool operated combination lock is packaged within a standard ¾" diameter cylinder package, such that existing ¾" diameter cylinder locks may be replaced with the tool operated combination lock unit. Of course, it will be appreciated that the tool operated combination lock unit may be smaller or larger depending on the desired application. Whether larger or smaller, the tool operated combination lock is preferably a simple, low part count, low cost, robust, environmentally hardened, and highly pick resistant mechanism.

As shown in FIG. 1, in accordance with one aspect of the present invention, a combination lock 100 may comprise a casing 102 adapted to house a series of disks, such as six disks as in the embodiment shown in FIG. 1. These disks include a drive disk 104 and five standard disks 106*a*, 106*b*, 106*c*, 106*d*, and 106*e*. The combination lock 100 may also comprise other primary components including a drive cylinder 108, latch 110, drive shaft 112, side bar 114, and end cap 116. As with conventional locks of the combination disk type, the components are arranged such that rotation of the drive shaft 112 in alternating clockwise and counterclockwise directions, in accordance with a specific pattern or combination, permits the side bar 114 to drop into aligned gates 118 formed in each of the disks 104, 106*a*, 106*b*, 106*c*, 106*d*, 106*e*, and out of a notch 120 provided in the casing, such that the latch 110 may rotate to unlock the combination lock 100. In this simplistic regard, the combination lock 100 operates much like conventional combination locks. Other components are also utilized in the combination lock 100, and will be discussed in turn.

Figure 2:
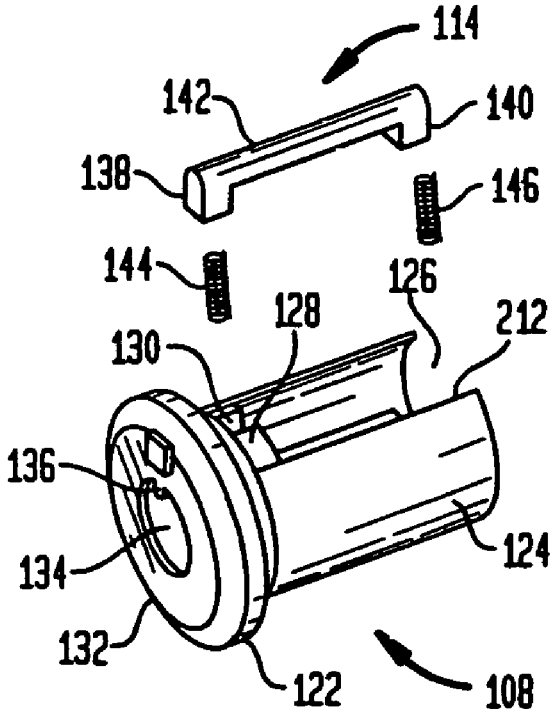
FIG. 2 is a blown-up view of a portion of the combination lock of FIG. 1 generally depicting a drive cylinder.

As shown in FIG. 2, a blown-up view of portions of FIG. 1, the drive cylinder 108 comprises a flange 122 and an extension area 124, the flange generally being formed to a greater diameter than the extension area. The extension area 124 is formed to fit within the inside diameter of the casing 102 when the combination lock 100 is assembled, and is typically ¾-round construction with an open top area 126.

Located at the intersection of the flange 122 and the extension area 124 in an internal portion of the drive cylinder, is a front cap 128. The front cap 128 comprises a front cap gate 130 in which portions of the side bar 114 may fit when the combination lock 100 is assembled.

On the opposite side of the flange 122 from the front cap 128, an external side, is a front face 132. It will be appreciated that the front face 132 is the portion of the combination lock 100 which is visible to the user upon installation of the cylinder lock in the final device, such as the door or padlock. The front face 132 includes an aperture 134 through which the drive shaft 112 may be accessed when the combination lock 100 is assembled, as will be discussed.

The aperture 134 is preferably circular, but may also include geometric or non-geometric features that limit entry into the aperture to tools which are shaped properly or incorporate features corresponding to the apertures' features. For example, in FIG. 1, the aperture 134 is shown as a circular aperture with a tab 136 extending into the face thereof. Accordingly, a tool with a corresponding notch will be capable of entering the aperture. In other embodiments, the tool and lock may include a separate lock and tab serving to orient and register relative positions of the lock mechanism.

The lock may further comprise a communication mechanism 135, such as those discussed herein, to communicate with a tool.

As further shown in FIG. 2, the side bar 114 may comprise legs 138, 140 extending from ends of a relatively lengthy main portion 142. The side bar 114, particularly the legs 138, 140, may be associated with springs 144, 146, as will be discussed.

Figure 3:
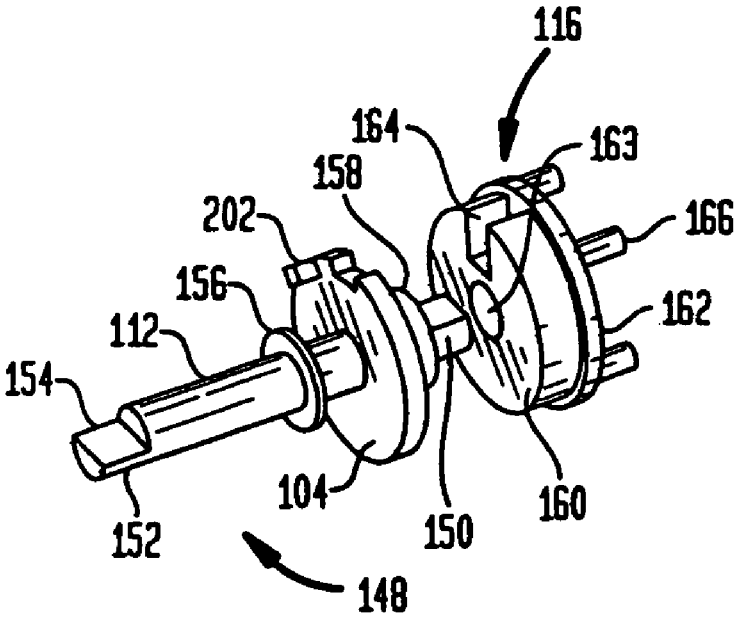
FIG. 3 is a blown-up view of a portion of the combination lock of FIG. 1 generally depicting a drive assembly.

FIG. 3 depicts another blown-up view of portions of FIG. 1, this time corresponding to the drive assembly 148 and end cap 116 without the optional scrambler spring 204, which will be discussed in relation to FIG. 7. The drive assembly 148 is comprised of the drive disk 104 and drive shaft 112, which may be formed as a single component, and may be cast as such or assembled from separate parts. The drive disk 104 is typically mounted on the drive shaft 112 toward a distal portion 150 of the drive shaft. This arrangement leaves room on the proximal portion 152 of the drive shaft 112 for disks 106, the number of disks varying depending on the desired security level of the combination lock 100.

The extreme proximal portion 152 of the drive shaft 112 includes an alignment notch 154. The proximal portion 152 of the drive shaft 112 with the alignment notch 154 is accessible through the aperture 134 of the drive cylinder 108 when the combination lock 100 is assembled. The alignment notch 154 therefore serves at least two purposes; namely, the alignment notch provides an engaging surface with which a tool may engage to open the combination lock 100 and also provides the tool with registration information so the tool may go through the required series of rotations with a calibrated reference point relative to tab 136.

A pair of drive assembly spacers in the form of a proximal drive assembly spacer 156 and a distal drive assembly spacer 158 are mounted on the drive shaft 112 on opposite sides of the drive disk 104. The drive assembly spacers 156, 158 are offset a certain distance from the drive disk 104 to ensure that the drive disk remains that same certain distance from the endcap 116 on its distal side and the first disk 106*a* on its proximate side, when the combination lock 100 is assembled. The spacers 156, 158 also provide mechanical isolation between discs to prevent inadvertent rotation of discs.

In its assembled form, the drive assembly 148 is secured within the extension area 124 of the drive cylinder 108. In this regard, it will be appreciated that portions of the drive disk 104 will be concealed by the ¾ round extension area 124 while other portions are left exposed by the open top area 126. The drive assembly 148 is followed within the extension area 124 of the drive cylinder 108 by the end cap 116 when the cylinder lock is assembled. End cap 116 may be fixed to extension area 124 by adhesives, solder, brazing, welding, mechanical fasteners, or the like.

The end cap 116 includes a cylindrical portion 160 ending in a flange 162 at its distal end. The cylindrical portion 160 includes an aperture 163 within which the drive shaft 112, and particularly the overtorque control portion 150 between the distal end of the drive shaft and distal drive assembly spacer 158, may be placed when the combination lock 100 is assembled. The cylindrical portion 160 also includes a side bar gate 164 within which a leg 140 of the side bar 114 may lay, as will be discussed.

Extending distally from the flange portion 162 of the end cap 116 is at least one connecting post 166. Preferably, four such posts are provided in equally spaced relation. The connecting posts 166 are adapted to connect the end cap 116 to an end plug (FIG. 4) when the combination lock 100 is assembled. The connecting posts 166 are therefore operative to force rotation of the end plug (FIG. 4) upon rotation of the end cap 116.

Figure 4:
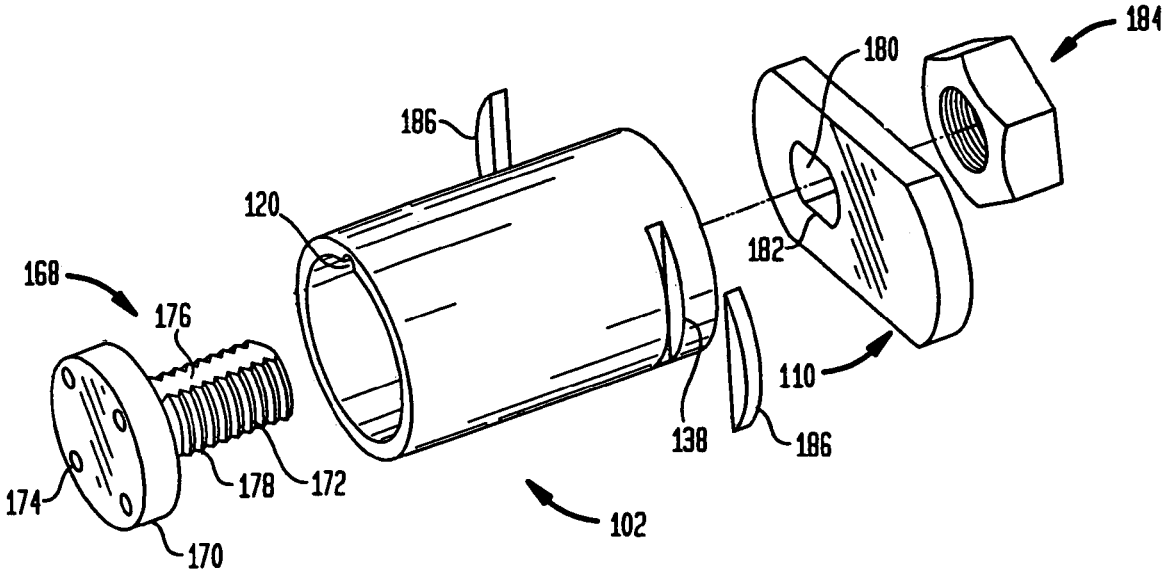
FIG. 4 is a blown-up view of a portion of the combination lock of FIG. 1 generally depicting a casing.

As shown in FIG. 4, a blow-up of still further portions of FIG. 1, the end plug 168 comprises a disk-shaped head portion 170 and a generally cylindrical threaded portion 172, the threaded portion being of a smaller diameter than the head portion. The head portion 170 includes at least one recess 174 sized and shaped in registration with the at least one connecting post 166 extending from the end cap 116, such that the connecting post may enter the recess upon assembly of the combination lock 100. In preferred embodiments, there are four such recesses 174 to mate with four corresponding connecting posts 166.

The threaded portion 172 of the end plug 168 extends distally from the head portion 170 and is preferably concentric therewith. The generally cylindrical threaded portion 172 includes a pair of opposed flat sections 176 separating threads 178, such that the end plug 168 has the general appearance of a bolt, a commonly used configuration for cam cylinders. Of course there are many other suitable configurations.

The combination of the threads 178 and flat sections 176 are adapted to be inserted into an aperture 180 provided in the latch 110 upon assembly of the combination lock 100. The latch aperture 180 is shaped such that it includes flat sections 182 corresponding to the flat sections 176 of the end plug 168. In this regard, once the threaded portions 178 of the end plug 168 are inserted through the aperture 180 of the latch 110, the latch will rotate together in corresponding rotation with rotation of the end plug 168. A nut 184 is provided to hold the latch 110 to the end plug 168, the nut being threaded onto the threads 178 provided on the threaded portion 172 of the end plug.

Also shown in FIG. 4 are cylinder retention clips 186. The cylinder retention clips 186 are operative to engage with recess 188 formed within the casing 102. The retention clips 186 assist with retaining the combination lock 100 within the mechanism of final assembly, such as a door. Retention clips 186 and combination locks generally utilizing retention chips are well-known in the art.

Figure 5:
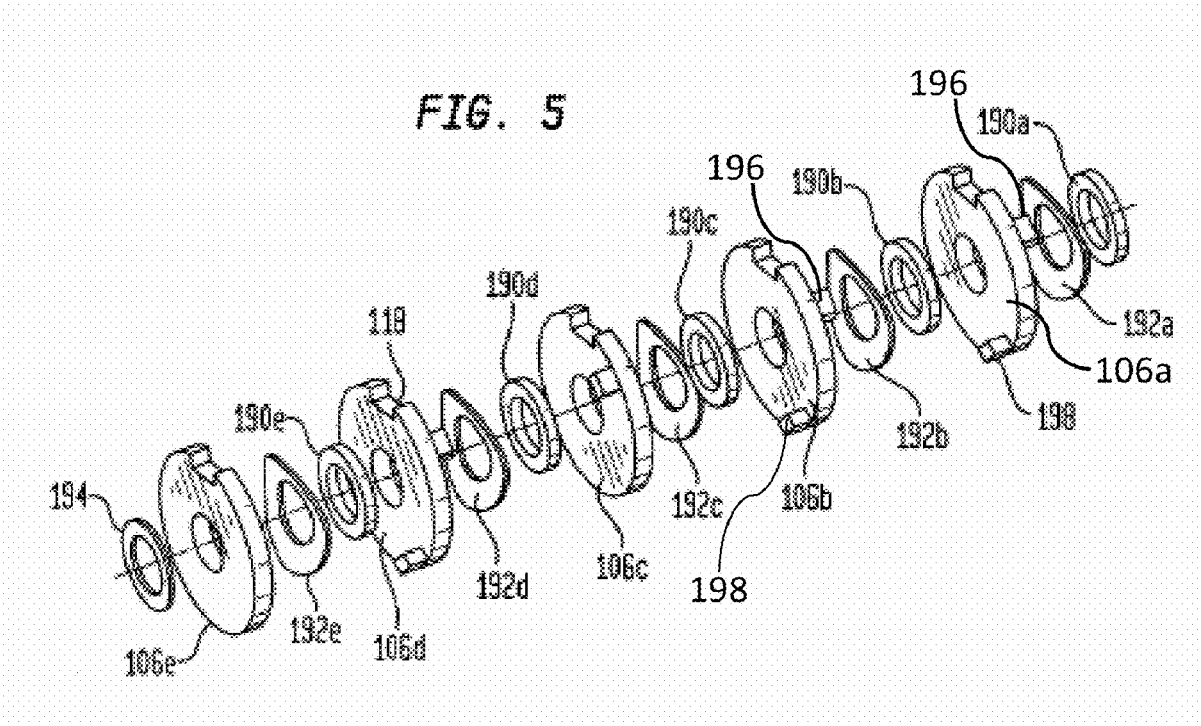
FIG. 5 is a blown-up view of a portion of the combination lock of FIG. 1 generally depicting a plurality of disks.

In a final blow-up of FIG. 1, FIG. 5 depicts the arrangement of standard disks, such as disks 106*a*, 106*b*, 106*c*, 106*d*, 106*e*, utilized in accordance with the particular and exemplary aspect of the invention shown in FIG. 1. It is noted herein that while the particular embodiment depicted in FIG. 1 incorporates five such disks, the invention is not so limited. In fact, it is anticipated that less or more disks may be utilized—as the combination lock is not constrained by the limits of human dexterity, memory or the like.

It is well-known that as the number of disks increases, there are less practical areas of gates available on any single disk. This is due to "nulls" created by the overlapping positions of adjacent disks. As a practical example, when two disks are used, it is estimated that 46 gate positions may be available for use on either of the disks in a conventionally sized ¾" diameter combination lock. Yet, if five disks are used, the number of available gate positions may be reduced to approximately 40 positions per disk. These figures may be further reduced depending on gate and side bar dimensions and clearances, or the dimensions of the fly and pusher. In locks of the type described herein, the available gates per disk may further be reduced as a function of the tool's angular positioning resolution and tolerances.

The following table depicts the approximate number of combinations available for combination locks with various numbers of disks, as well as the time it would take for a malfeasant to cycle through all of the combination permutations, assuming each permutation could be cycled through in one second. This table assumes 7.5 degree increments for the gates (360/7.5=40) and that the fly and pusher occupy 15 degrees each. As is shown, the number of combinations, and thus the time it would take to cycle through the permutations, grows exponentially with the number of disks. The current practical limit of four disks theoretically allows for approximately four million permutations. A five disk cylinder lock, such as that created by Joseph L. Hall of Cincinnati, Ohio, in the mid-1800s, theoretically permits approximately 163 million combinations if constructed in accordance with today's state of the art designs and with today's state of the art materials. The five disk lock has proven to be too cumbersome for human use, and has never become accepted in commercial use. Notwithstanding, aspects of the present invention now make it practical to place combination locks with over five disks into the stream of commerce.

TABLE 1 i. Permutations and time to cycle all combinations assuming a theoretical number of positions per disk.

| No. disks | No. Pos. | No. Permutations | Time Hours | Days | Years |
|---|---|---|---|---|---|
| 1 | 48 | 48 | 0.013 | | |
| 2 | 46 | 2,208 | 1 | | |
| 3 | 44 | 97,152 | 81 | 3 | |
| 4 | 42 | 4,080,384 | 4534 | 189 | 0.5 |
| 5 | 40 | 163,215,360 | 226688 | 9445 | 26 |
| 6 | 38 | 6,202,183,680 | 10336973 | 430707 | 1180 |
| 7 | 36 | 223,278,612,480 | 434152858 | 18089702 | 49561 |

Referring again to FIG. 5, it is shown that a combination lock 100 may include five standard disks, 106*a*, 106*b*, 106*c*, 106*d*, 106*e*. Again, cylinder locks manufactured in accordance with the present invention may include less or even more disks, notwithstanding the five disks shown. In addition to the disks 106*a*, 106*b*, 106*c*, 106*d*, 106*e*, FIG. 5 depicts spacers 190*a*, 190*b*, 190*c*, 190*d*, 109*e*, and spring washers 192*a*, 192*b*, 192*c*, 192*d*, 192*e*, associated with each disk. Each of the disks 106*a*, 106*b*, 106*c*, 106*d*, 106*e*, includes a spring washer 192*a*, 192*b*, 192*c*, 192*d*, 192*e*, and spacer 190*a*, 190*b*, 190*c*, 190*d*, 190*e*, in that order, moving from the proximal end toward the distal end of the combination lock 100. This arrangement is well-known in the industry and serves to properly space the disks 106*a*, 106*b*, 106*c*, 106*d*, 106*e*, while also providing compression on the disks by virtue of the spring washers 192*a*, 192*b*, 192*c*, 192*d*, 192*e*.

At the extreme proximal end of the disks shown in FIG. 5, there is shown a thrust washer 194. Referring back to FIG. 2, it will be appreciated that the thrust washer 194 is spaced against the front cap 128 when the combination lock 100 is fully assembled.

Using disk 106*a* as an example, it will be appreciated that each disk 106*a*, 106*b*, 106*c*, 106*d*, 106*e*, includes a fly nib 196 and a pusher nib 198, with the fly nib on the distal side and the pusher nib on the proximal side. As will be discussed, upon rotation of the disks 106*a*, 106*b*, 106*c*, 106*d*, 106*e*, the pusher nib 198 of a first disk will engage the fly nib 196 of a second disk, on the proximal side of the first disk, to rotate the second disk. For example, upon rotation of disk 106*a*, pusher nib 198 will engage fly nib 196 of disk 106*b* to rotate disk 106*b*. This arrangement is commonly known in the art, where spacers 190*a*, 190*b*, 190*c*, 190*d*, 190*e*, also provide mechanical isolation between discs to ensure that adjacent discs only move when fly and pusher nibs are in contact.

Figure 6:
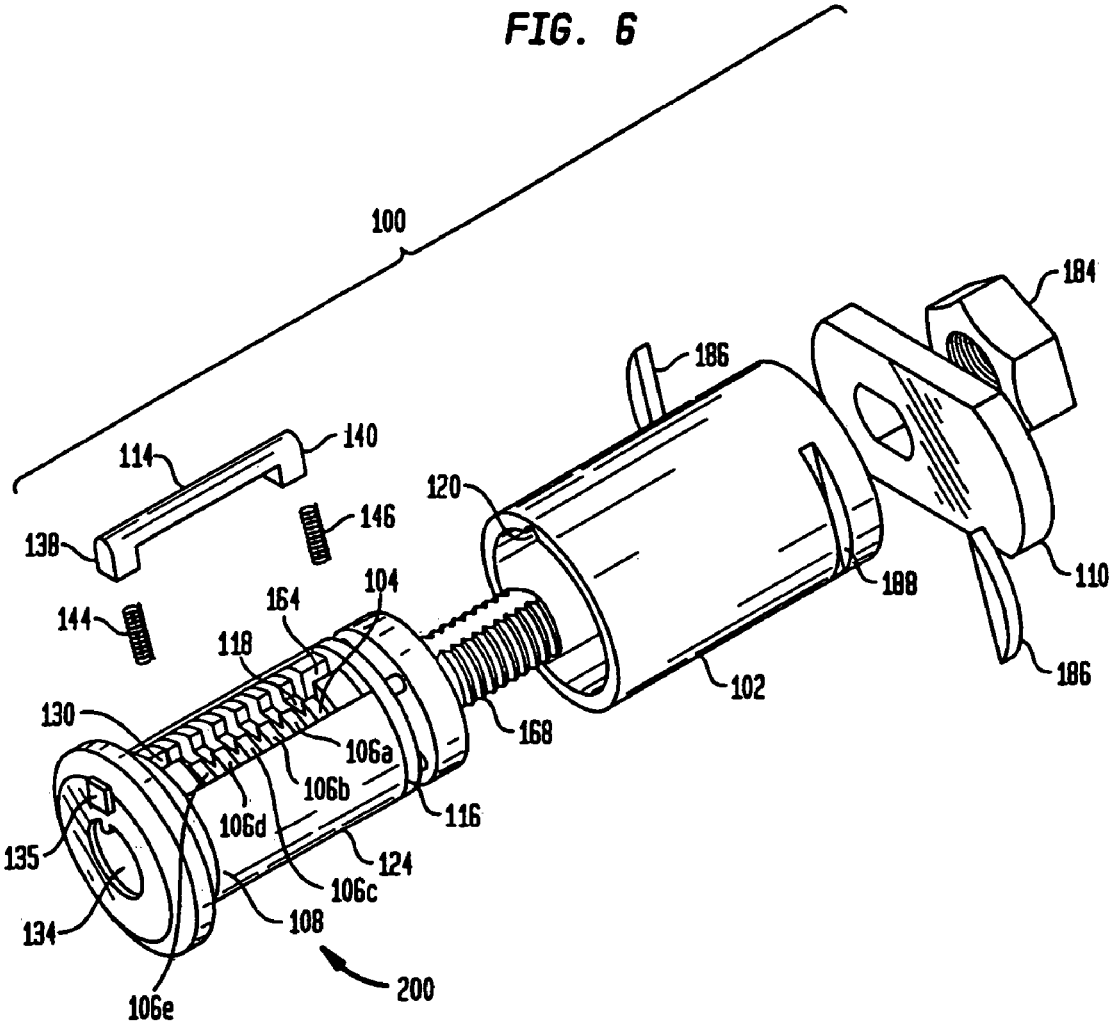
FIG. 6 is a partially assembled perspective view of the combination lock of FIG. 1.

FIG. 6 depicts the combination lock 100 of FIG. 1 in a nearly assembled condition. As shown, the disks 106*a*, 106*b*, 106*c*, 106*d*, 106*e*, have been assembled into the extension portion 124 of the drive cylinder 108, with the drive assembly 148 and end plug 168 following. This complete arrangement is referred to as the disk core 200.

In a completely assembled condition, the legs 138, 140 of the side bar 114 would be installed into the front cap gate 130 and the side bar gate 164 respectively, with the springs 144, 146 therebetween. The casing 102 would then be slid over the extension portion 124 of the drive cylinder 108 such that the side bar 114 is lodged within the notch 120 provided in the casing. Once so positioned, the cylinder retention clips 186 may be positioned within the cylinder retention clip slots 188 of the casing 102, such that they are lodged between the end plug 168 and the end cap 116 to retain the disk core within the casing. Finally the latch 110 may be placed over the threaded portion 172 of the end plug 168 and secured with the nut 184.

The operation of the cylinder lock of the present invention, such as the combination lock 100 shown in FIG. 1, is very similar to conventional cylinder locks, with the exception that the present cylinder lock preferably requires great accuracy of input due to the increased tolerances afforded by the tool and more rotations of the drive shaft 112 due to the greater number of disks provided. Accordingly, in order to unlock the combination lock 100, a user would be required to insert the mating element of a tool having specific features which will be further described below, into the aperture 134 such that the mating element interfaces with the alignment notch 154 of the drive shaft 112. The mating element must then be rotated in accordance with the proper rotational pattern to unlock the lock.

The rotational pattern is typically clockwise, counterclockwise, clockwise, and so on. Because there are no external markings to indicate rotational degrees of the mating element and thus of the drive shaft 112, the tool must "know" how many of degrees of rotation through which it has traveled on each pass, and the correct combination for the lock. The tool may "know" this through various means, such as the means discussed above with respect to the "dumb," "not-so-dumb," and "smart" tools.

In any event, once the tool "knows" the correct combination, the engagement of the mating element with the drive shaft 112 permits the lock opening sequence to begin. Once begun, the mating element will rotate the drive shaft 112 through revolutions in a single direction at least equaling the number of disks in the lock to ensure that the disks are properly aligned in a beginning sequence. This rotation rotates the drive disk 104, for example in a clockwise direction. Each of the subsequent disks is "picked up" by the pusher nib of the preceding disk until the disks are aligned. Once the number of revolutions is reached, the drive disk 104 is then rotated in the counterclockwise direction one complete revolution such that the pusher nib 202 of the drive disk engages with the fly nib 196 of disk 106*a*. The rotation is then continued in the same direction until all of the pusher nibs 198 of the disks 106*a*, 106*b*, 106*c* are engaged with the fly nibs 196 of the adjacent disks. The rotation is ceased when the gate 118 of disk 106*d* is aligned directly below side bar 114, a location previously calibrated to a particular combination.

To calibrate the tool and the lock, the rotations may account for the offset of the alignment notch 154 of the drive shaft 112 and the tab 136 extending into the aperture 134 of the lock 100, as previously discussed. The tool may, therefore, include a mechanism to detect this offset. In order to permit the tool to mate with the alignment notch 154 of the drive shaft 112 no matter what orientation the alignment notch is in, the mating mechanism of the tool may be free to rotate and shaped such that it moves freely into position aligned with the alignment notch automatically as the mating of the lock and tool occurs. In order to move into such position, the opposing surfaces may be cammed or chamfered.

In this regard, it will be appreciated that the tolerance between the gate 118 and the side bar 114 of the present invention may be much tighter than those of conventional human operated cylinder locks because of the precise control exercised by the tool, which is vastly superior to average human dexterity. This serves several advantages. First, it permits a greater number of possible gates 118 per disk. It should be obvious that the greater number of gates 118 locations per disk, the greater number of possible combinations. Also, this enables the lock to be much more pick resistant, as the tighter tolerances make it much more difficult for a malfeasant to "feel" the gate as the disk is rotated in an attempt to pick the cylinder lock in the conventional manner known in the art.

Once the first disk 106*e* is properly aligned, the tool rotates the drive shaft 112 in the opposite direction such that the pusher nib 202 of the drive disk 104 engages the fly nib 196 of disk 106*a* in preparation for rotation of disk 106*a* in the opposite direction. The tool continues to rotate the drive shaft 112 until the rotations equal the number of disks minus one, such that disk 106*d* is not now "picked up" by the rotations. The proper number of rotations and more specifically, the proper degree of rotation will then leave the gate 118 of disk 106*d* aligned directly below the side bar 114. This procedure is then repeated until all of the gates 118 are aligned directly below the side bar 114.

Once the gates 118 are aligned, the entire drive cylinder 108 may be rotated within the casing 102. This causes the main portion 142 of the side bar 114 to drop down into the gates 118 and the legs 138, 140 of the side bar to drop into the front cap gate 130 and the end cap gate 164, respectively, as the notch 120 of the casing cams the side bar, compressing springs 144, 146. It will be appreciated that such rotation influences the end cap 116 and the end plug 168 to rotate, causing the latch 110 to similarly rotate opening the combination lock 100. If the gates 118 are not aligned, it is well-known in the art that the casing 102 may not rotate as the side bar 114 interferes with any attempted rotation.

As noted, the combination lock 100 opening sequence is similar to the opening sequences known in the art, but expands upon those by incorporating a greater number of revolutions owing to the use of greater numbers of disks. In addition, there are preferably no external indications of rotation degrees. Accordingly, the combination lock may not be operated without the precision of the tool.

In addition to the features of the combination lock 100 discussed above with respect to FIG. 1, certain other embodiments of cylinder locks may incorporate additional features. One such feature is the scrambler spring 204 which is also depicted in FIG. 1 as an optional accessory. The scrambler spring 204 may be included to provide a torsional force between the drive disk 104 and the drive cylinder 108.

Figure 7:
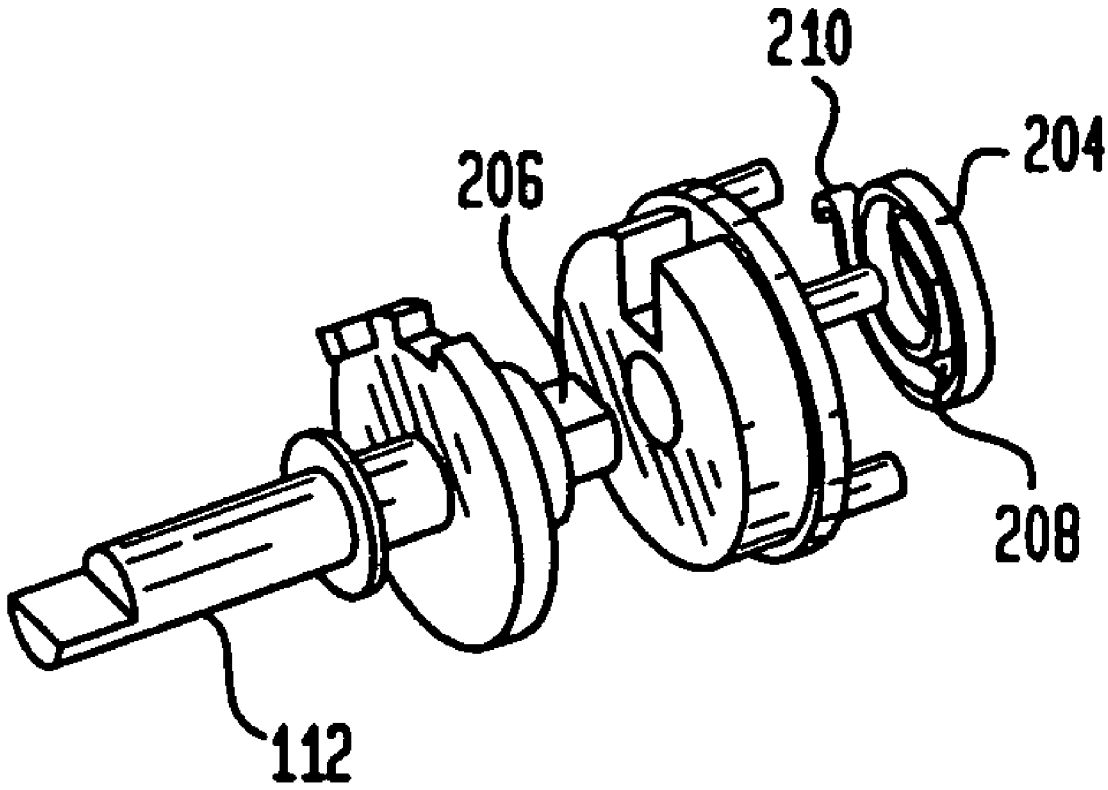
FIG. 7 is a blown-up view of a portion of the combination lock of FIG. 1 generally depicting a drive assembly with optional components.

As shown in FIG. 7, a blow-up of portions of FIG. 1 similar to the view shown in FIG. 3 but with the addition of the optional scrambler spring 204, on the extreme distal end of the drive shaft 112 beyond the distal drive assembly spacer 158, the drive shaft may comprise a flat surface, referred to herein as an overtorque control surface 206. The overtorque control surface 206 may cooperate with a flat first end 208 of the scrambler spring 204 to progressively rotate and add potential energy to the scrambler spring as the drive shaft 112 is rotated. The second end 210 of the scrambler spring 204 may be hook-shaped to latch onto the edge 212 (FIG. 2) of the extension area 124 of the drive cylinder 108 to hold the second end of the scrambler spring in place.

When the scrambler spring 204 is included, rotation of the drive shaft 112 will rotate portions of the scrambler spring such that the spring is energized. The standard tool utilized to achieve such rotation includes sufficient power to overcome the resistance of the spring 204. Once the lock has been opened, and the tool is removed, the now energized scrambler spring 204 serves to rotate the disks in a random pattern such that the disks are no longer aligned. This is done primarily as an added security feature, but also serves to reinforce the need for tool operation rather than human operation. If the lock includes a scrambler spring 204, human manipulation of the lock becomes more difficult as the spring may tend to turn the external dial (if so provided) through degrees of revolution not known by the user whenever the user loses a tight grasp of the external dial (if so provided). In lieu of a scrambling spring, the lock may be scrambled by the tool after the lock has been opened and before the tool is extracted. This scrambling algorithm may be programmed into the tool, and only needs to scramble one disk to ensure that the lock relocks. Of course the side bar would need to be in the recessed (unlocked) position before the algorithm is run. In this regard, the lock may incorporate a tool retention feature such that the tool may not be removed from the lock until the sidebar is returned to the recessed (unlocked) position.

Figure 8:
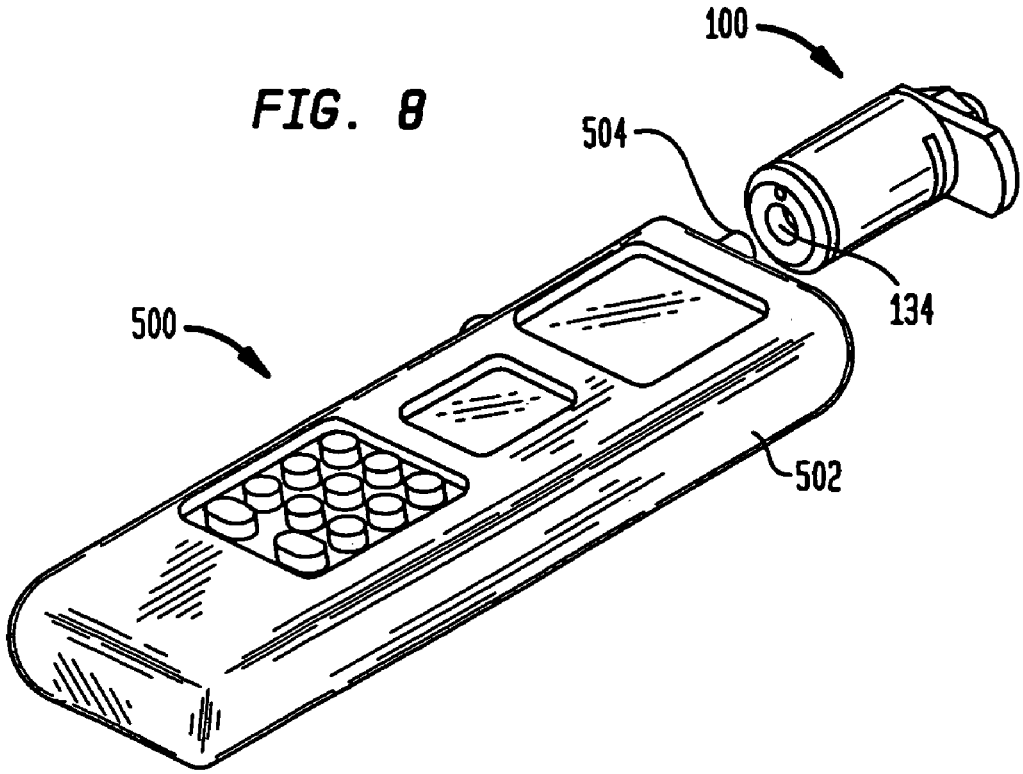
FIG. 8 is a perspective view of a tool in accordance with one embodiment of the present invention in a first relation with a combination lock of the type shown in FIG. 1.
Figure 9:
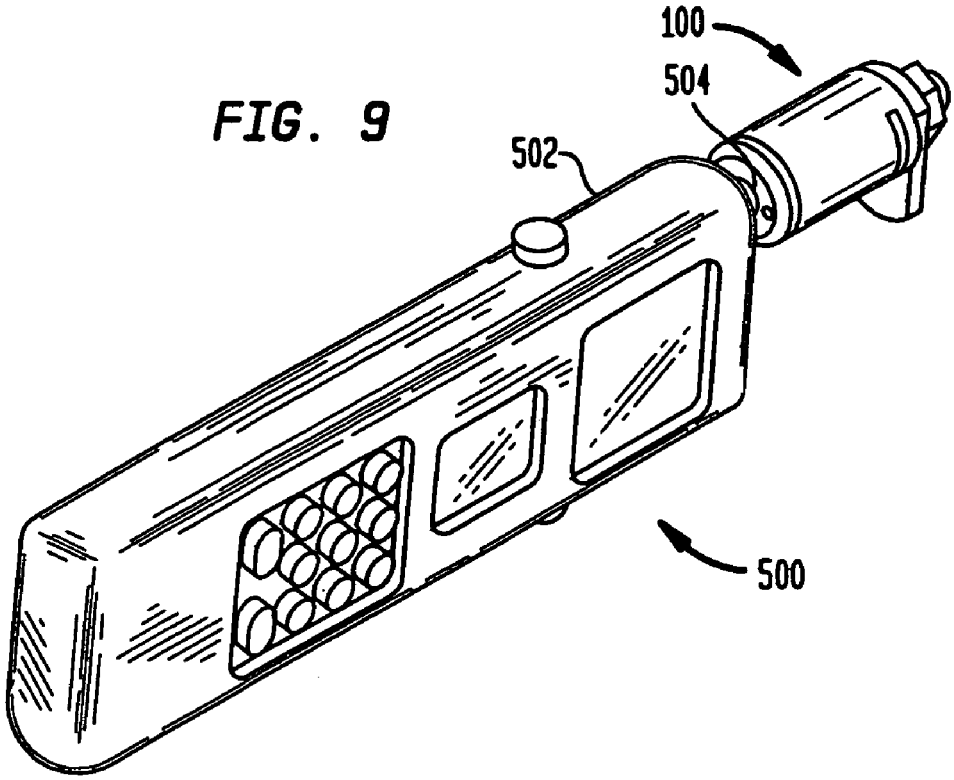
FIG. 9 is a perspective view of the tool and combination lock of FIG. 8 in a second relation.

FIGS. 8 and 9 depict a tool 500 in accordance with certain aspects of the present invention alongside a combination lock 100. As shown, the tool 500 may include a body 502 and a cylinder lock interface 504. The cylinder lock interface 504 is adapted to fit within the aperture 134 and engage the drive shaft 112 generally, and particularly the alignment notch 154.

FIG. 8 generally depicts the tool 500 prior to engagement with the combination lock 100. As previously discussed, the lock interface 504 of the tool 500 may engage the combination lock 100. Once engaged, the lock interface 504 may go through its series of rotations to unlock the combination lock 100. The entire tool 500 may then be rotated to rotate the drive cylinder 108 and latch 110, to the position shown in FIG. 9 from that shown in FIG. 8, to unlock the lock.

Figure 10:
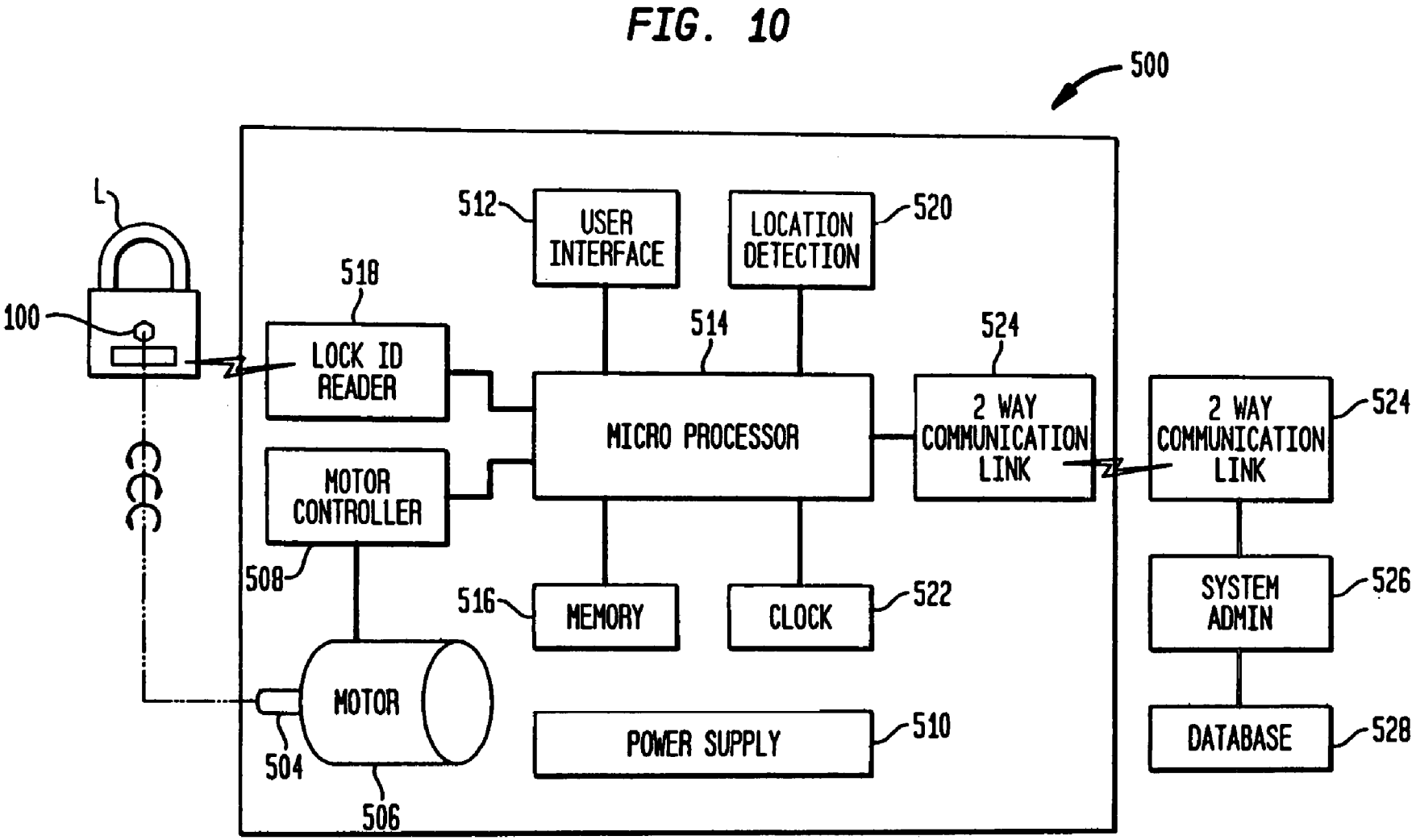
FIG. 10 is a functional diagram of a tool in accordance with one embodiment of the present invention.

FIG. 10 depicts a functional diagram of a typical tool, such as tool 500 adjacent to lock L incorporating a combination lock 100. At a minimum, the tool 500 typically includes a motor 506, motor controller 508, power supply 510, and user interface 512 (in which case the user interface 512 may be directly associated with the motor controller 508). This arrangement of components may be considered a "dumb tool," as previously discussed. The tool 500 may therefore function to open the cylinder lock, such as combination lock 100, when the user interface 512 is activated. When the user interface 512 is activated, the power supply 510 will provide power to the motor controller 508 which will activate the motor 506. Again, this represents to most basic of tools, such as the "dumb tool" previously described.

Typically, the power supply 510 will be a standard power supply, such as 6, 12. or 18 volt DC. More or less powerful units may also be utilized if desired, or based on engineering and design criteria. AC power, either exclusively or in combination with the DC circuitry, may also be provided if so desired.

The motors 506 preferred for tools of this type are fine stepper motors, although other types of motors such as servo motors with position encoders may also be utilized. Stepper motors capable of the fine accuracy and range of motion required for this application are well known in the art. Such motors offer the ability to "stop on a dime," and may rotate both clockwise and counterclockwise while retaining a extremely fine level of accuracy.

In the most basic form, the user interface 512 may be a simple on/off button or switch. For example, a "dumb" tool may operate to open locks having only one combination. The tool 500 may therefore rotate the cylinder lock interface 504 through a single combination at the instant the on/off button is activated. Thus, the motor controller 508 serves as the only memory and processing unit required.

The basic tool may incorporate components which are equivalent or which may be derived from those taught in U.S. Pat. No. 5,017,851 issued to Heinzman, the disclosures of which are incorporated herein by reference. These components may include the microprocessor 514, motor controller 508, memory 516, motor 506, and user interface 512, among other possible components such as power supply components. An example of a microprocessor 514 which may be utilized in the present invention is the ubiquitous Zilog® Z80 8-bit microprocessor. Zilog® is a registered trademark of Zilog, Inc., 910 East Hamilton Avenue, Campbell, Calif. 95008.

In more sophisticated tools, such as "not-so-dumb tools," the tool 500 may also include optional features such as more elaborate user interfaces 512, microprocessors 514, memory modules 516, and lock identification readers 518. The "not-so-dumb tool" may also incorporate location detection means 520, such as GPS, RFID, cellular technology, or the like. Finally, the "not-so-dumb tool" may also incorporate an internal clock 522, for recording the timing of particular events or other clock-related functions.

The functions of each of these elements have been previously discussed, and may be utilized in any combination to suit the purposes of the circumstance.

In the most sophisticated tools, such as "smart tools," the tool 500 may also incorporate means for communicating to a remote station, such as a two way communication link 524, which may in turn be associated with a system administrator 526 and database 528.

Any of the aforementioned components may be split into separable components. For example, the power supply 510, motor 506 and motor controller 508 tend to be larger and bulkier than other components, particularly the memory 516, clock 522, and microprocessor 514. In addition, these components may be slower to evolve technically so may not require as frequent updating. As such, the power supply 510, motor 506 and motor controller 508 may be provided in a separate housing from the other elements. FIG. 11 depicts a tool 600 provided with separate housings for various components. In this particular example, the tool 600 comprises first housing 602 and a second housing 604. The first housing comprises the user interface 606 and cylinder lock interface 608 on its exterior. Although not shown, it will be appreciated that the interior portions of the housing may include at least the power supply, motor and motor controller. The second housing 604 is preferably sized to be relatively small, such as the approximate size a car's key-fob. In this regard, the second housing 604 may be designed to be carried on a key chain. The interior portions of the second housing 604, although not shown, may include at least the microprocessor and memory module. Without the second housing 604, the first housing 602 would not be able to open the lock, and vice versa. In addition to the components previously identified, the existence of the housings 602, 604 would also require mating elements (not shown) between the two. Such mating elements may include metallic contact strips, as commonly known in the electrical arts.

By utilizing separable components, an authority utilizing the separable tool to open combination locks may enjoy a much greater range of procedures and potentially higher levels of security than with a tool incorporating each of the features in a single housing. Additionally, cost savings may be realized. For example, the first housing 602 may be used generically between several operators, each having their own second housing 604. This sharing not only leads to cost savings realized through shared use, but also may permit better accounting of the whereabouts of the first housing 602, as it may always be with an on-shift user. For example, in a typical three shift day, if each of the three users possessed a tool incorporating all of the features required to open the combination lock, then three tools could potentially be stolen or misused at any one time. If, however, a shared first housing was utilized, only one theft or misuse component would be at risk. If a thief or malfeasant were to steal or misuse only the second housing, they still could not unlock a combination lock of the present invention without the first housing. Of course, even if one were to steal both housing, or a single tool incorporating all of the required features to open a lock, additional layered security may be included, such as biometrics, passwords, pin numbers, and the like associated with the user interface. Other security measures such as time and location recognition and authorization for use may also be incorporated.

In accordance with one particular aspect of the present invention, the use of RFID tagging may permit additional security levels not heretofore realized. In this regard, a tool, whether being self-contained or separable, may include an RFID sensing device. In order for the tool to operate, the sensing device may have to sense a particularly coded RFID tag in its vicinity. Such a tag may be carried by the user, for example in a credit-card sized device, key fob, wrist bracelet, neck pendant, or the like. Therefore, only an individual with an authorized RFID tag may be able to operate the tool, while all others will be electronically locked out.

Known technologies may be utilized for this purpose. Preferably, employment of an RFID tag sensing device within the tool and RFID tag carried by the user will not interfere with normal operation of the tool. By providing the RFID sensor with the capability of sensing within a conservative range, for example up to four or five feet, the user will not have to do anything other than have the RFID tag on his/her person, and the authorization process should not slow or otherwise impair operation of the tool.

Other similar authorization processes may also be employed. One such authorization process may be one where the tool includes a credit card-like magnetic strip swipe system. The user may swipe a magnetic coded pass card into the tool. The card may contain data required to authorize access. In another example, a user may be provided with a device that displays a pass code which changes at predetermined intervals, for example every 30 seconds. The tool may include a feature where the changing pass code must be entered into the tool for authorization prior to operation.

FIG. 12 depicts an exemplary tool 700 arranged in accordance with certain aspects of the present invention. As shown, the tool 700 may comprise an exterior housing 702 having a pistol-grip type handle 704. A drive element 706 may extend from a distal end of the exterior housing 702. As previously discussed, the drive element 706 is preferably adapted to mate with the drive shaft of a combination lock after entering the outer housing thereof, so as to rotate the drive shaft through the required combination. The drive element 706 may be formed to proprietary or non-proprietary shapes, to further enhance the security of the lock. Such shapes include polygonal, torx, splined, McGard®, or the like.

A registration element 710 may also be provided at the distal end 708 of the tool 700. The registration element may be a simple pin as shown, or may be more elaborate to further aid in the security of the device. The registration element 710 is adapted to mate with a corresponding element on the exterior portion of the combination lock (not shown), to align the tool in registration with the lock such that the required opening sequence may begin at a known reference point.

The distal end 708 of the tool 700 may also incorporate a sensor 712 adapted to identify the particular combination lock which is to be opened. As previously discussed, the sensor 712 may comprise an element adapted to read RF signals, optical signals, or magnetic signals, among others. The sensor 712 may also read barcodes, alphanumeric designators, or the like.

The tool may also incorporate a two way communication link 714 to link the tool's functioning to a remote authority. Such communication link 714 may comprise cellular, satellite, radio, IR, or other types of communication means.

The tool 700 may also incorporate a user interface 716, preferably at a proximal end 718 of the tool 700 for ease of use. The user interface 716, as previously discussed, may incorporate a key pad, LCD screen, card reader, biometric sensors, and the like, in order to securely control use of the tool 700.

In addition to the features shown and discussed with reference to tool 700, the tool may also comprise additional features not specifically discussed. Each of these features has been previously discussed with respect to FIG. 10, and may be incorporated into the tool either internally or externally, and in various combinations.

In addition to providing locks and tools separately, aspects of the present invention comprise systems of locks and tools engineered and constructed to work in tandem. Such locks and tools may comprise various combinations of elements previously discussed, all of which are entirely interchangeable depending on the nature of use to which the lock and tool will be put to.

Figure 13:
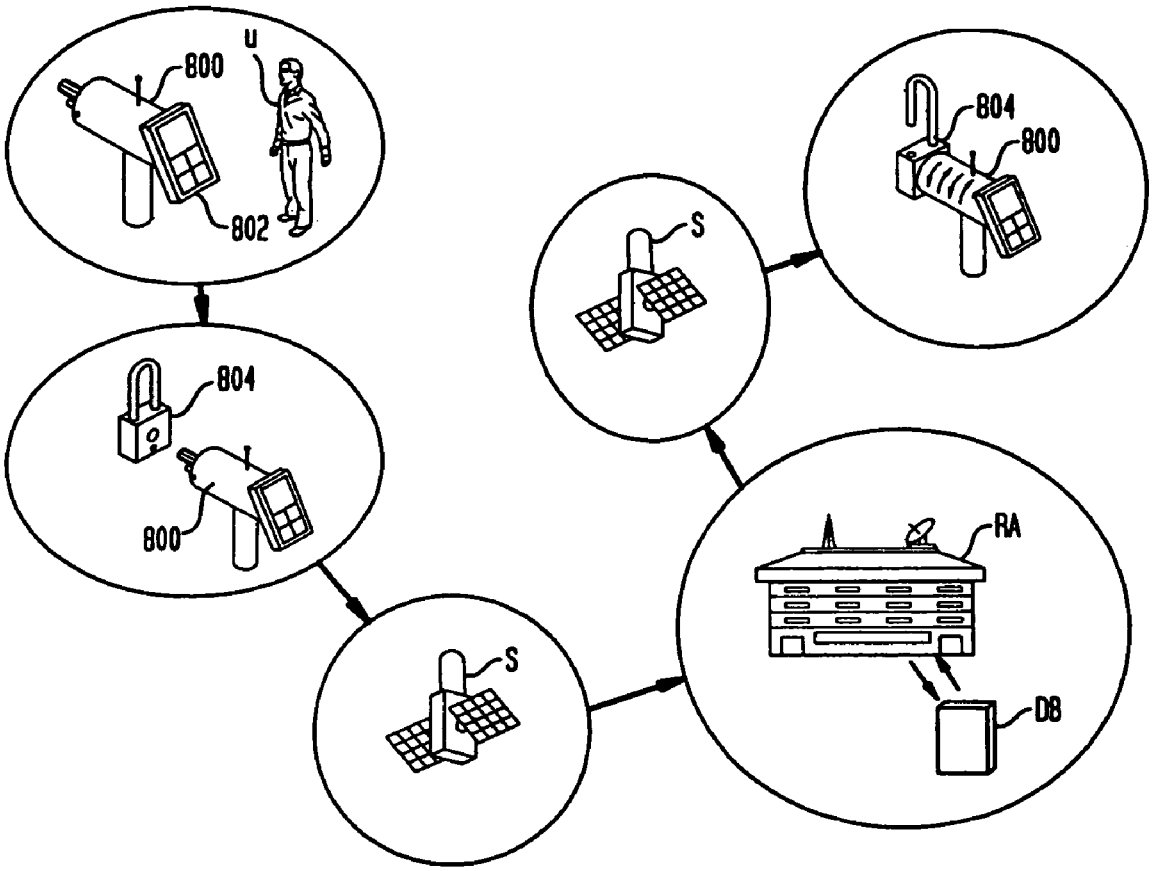
FIG. 13 is an overview of the typical operation of a tool in accordance with certain aspects of the present invention.

FIG. 13 depicts an overview of the typical operation of a tool in accordance with certain aspects of the present invention, particularly a "smart" tool incorporating exemplary features. As shown, a user U may obtain a tool 800 and validate the user's U identity via a validation process. The validation process may incorporate entry of a password into a user interface 802 forming a portion of the tool 800. The validation may also comprise use of biometrics or other validations means, as discussed.

The tool 800 may incorporate internal validation algorithms in its internal memory and process the algorithms through its processor, or the tool 800 may communicate with a remote station where the algorithms may be processed. In the most simplistic of locks, validation is based entirely on the input of user U. As such, if user U enters the correct validation information, the tool may be authorized for use. In other embodiments, validation may be based on input from the user U, as well as other factors, such as time of day, location of the tool, and identity of the combination lock.

In such case, the tool 800 may be mated with a combination lock 804 prior to validation. In this respect, the validation algorithm can determine if the particular user U is permitted to operate the lock in question 804. The mating of the tool 800 and the lock 804 permits a sensor (not shown) portion of the tool 800 to determine the characteristics of the lock in question 804, and to permit the tool itself to validate the information or to transmit the information to the remote authority RA. Such transmission may be through satellite communication S, as shown, or other communications means as previously discussed, for example landlines, cellular communications, IR communication, or the like. Once approval is received from the remote authority RA, the remote authority may store that information in a database DB. The remote authority may then communicate approval back to the tool through a satellite S or other means, and the tool may proceed with the angular positioning required to unlock the lock.

Figure 14A:
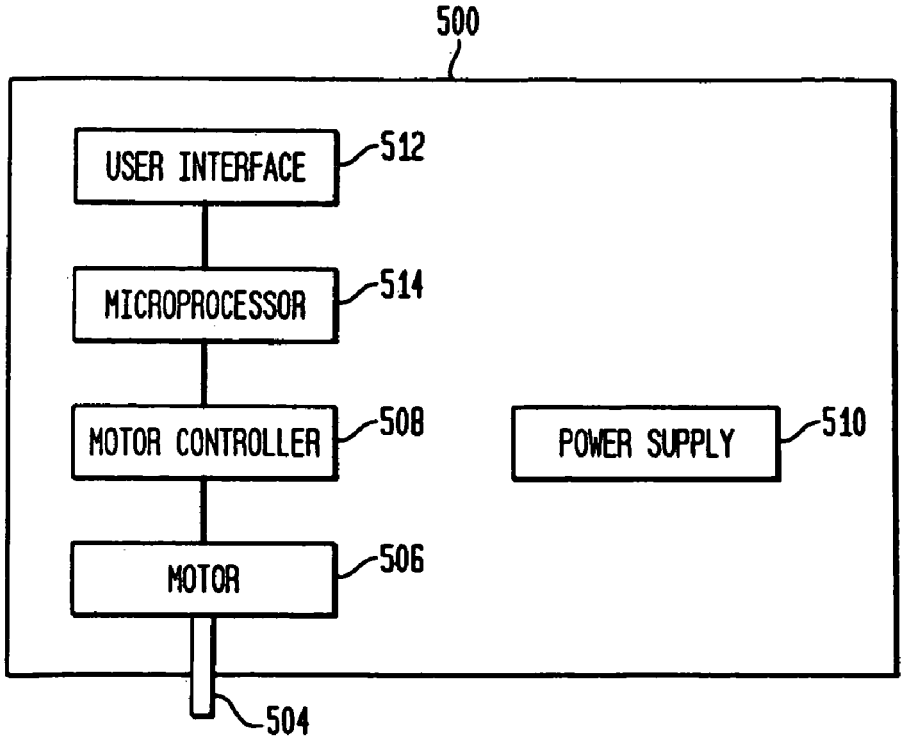
FIG. 14*a* is a logic diagram of a tool in accordance with certain aspects of the present invention.

A logic diagram of a typical tool, such as tool 500 shown in FIG. 10, is shown in FIG. 14*a*. As shown, tool 500 may include a user interface 512. The user interface may comprise a simple on/off switch, where in the simplest of tools 500 the user may place the switch in an operative position to initiate action of the tool. This signal may be sent to a microprocessor 514, in communication with the user interface 512. Again in the most simplest of tools 500, the microprocessor may include logic to instruct a motor controller 508 through operative steps to control a motor 506 through a series of clockwise and counterclockwise rotations, to rotate a cylinder lock interface 504 to open a lock. It will be appreciated that the lock 500 may also include a power supply 510 to provide power for these operations. In addition, the lock 500 preferably includes a registration element 710 adapted to mate with portions of a lock to provide a reference point for the start of angular rotations of said cylinder lock interface 504.

Figure 14B:
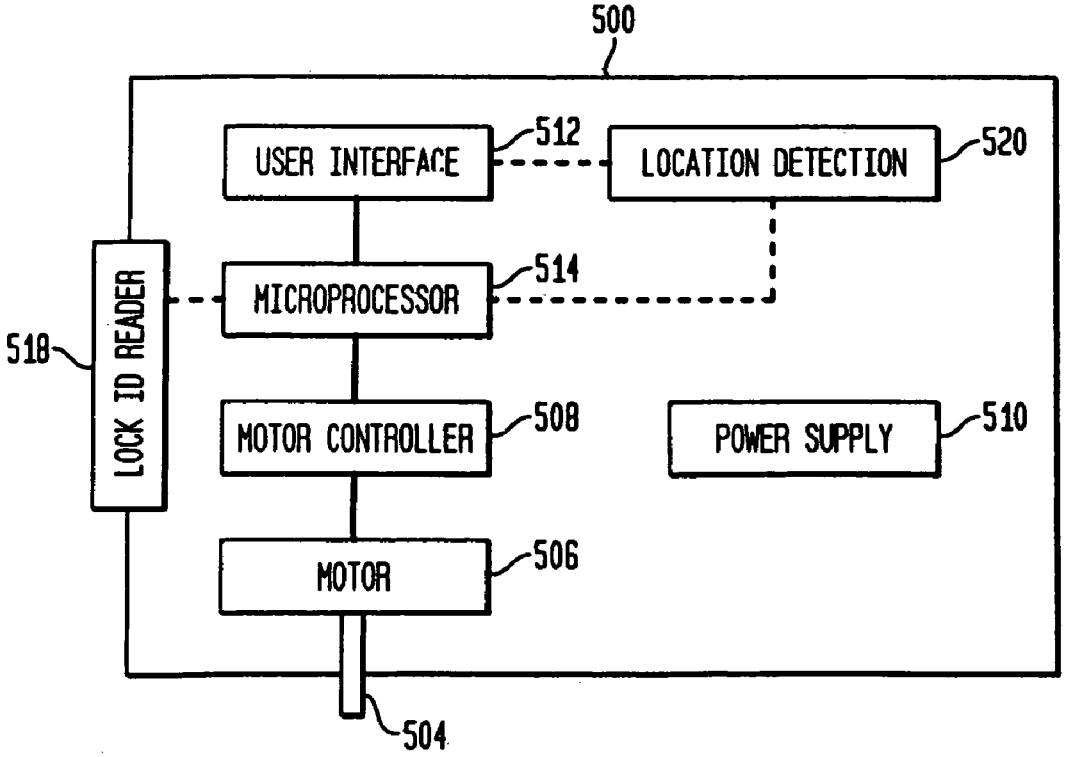
FIG. 14*b* is a logic diagram of a tool in accordance with further aspects of the present invention.

FIG. 14*b* builds on the disclosure of FIG. 14*a* by including additional elements, which may be included in tools of greater complexity than those shown in FIG. 14*a*. For example, in FIG. 14*b*, the user interface 512 may be a keypad rather than a simple on/off switch. In this regard, a user may input a code into the user interface 512, where the code is associated with a lock. The microprocessor 514 in this case may include a look-up table to determine the required opening sequence for the lock in question. If the code is entered wrong, the lock will not operate.

As an example of the types of security components which may be built onto the tools of the present invention, shown in dotted lines on FIG. 14*b* is an alternative logic sequence, wherein the tool 500 further incorporates use of GPS authorization. As shown, the user interface 512 may not be directly connected to the microprocessor 514. Rather, the path of communication may go through a location detection device 520, such as a GPS component. In this regard, the location detection device 520 may limit communication between the user interface 512 and the microprocessor 514 unless the tool is in a predetermined location. Other types of location detection devices 520 include RFID or cellular devices.

Alternatively, rather than the location detection device 520 being in series between the user interface 512 and the microprocessor 514, the location detection device may communicate directly with the microprocessor 514, which may include an algorithm seeking a specific response from the location detection device.

In lieu of the location detection device, the lock 500 may include other components identified above. These other components may include biometric detection devices, for example. In such case, the user may have to satisfy a biometric criteria before the tool 500 may be enabled. Again, each of the components previously identified may be included interchangeably, cumulatively, or left absent, depending on the complexity and security levels desired for the particular application.

In still further levels of sophistication, a tool 500 may include additional features beyond those shown in FIG. 14*a*, such as those shown in FIG. 14*b*. In FIG. 14*b*, a tool 500 is shown to also include a lock identification reader 518. The lock identification reader 518 may identify characteristics about the lock being opened, and communicate those to the microprocessor 514. These characteristics may be identified from various sources, such as contact memory buttons, "motes," bar codes, or the like, as described above. Once the identification of the lock is known by the tool 500, the microprocessor may correlate that identification with a look-up chart to determine the opening sequence for the lock in question. Once the sequence is known, a user input into the user interface may be required to initiate action of the tool 500. In other embodiments, the tool 500 may initiate automatically.

In still further embodiments, multiple look-up charts may be embedded into the logic of the microprocessor 514, for example the logic associated with a lock identification reader 518 and a location detection device 520. In this regard, the tool 500 may only operate to open a specific lock when the tool is in a specific location. Therefore, the tool 500 would identify the lock in question, then determine the locations in which the tool is authorized to open the lock. The microprocessor may obtain location information from the location detection device 520, to determine if the tool is in the proper location for that lock. Once the location detection criteria is met, the microprocessor 514 may proceed to look-up the combination for that particular lock, and transfer that information to the motor controller 508 to operate the tool.

Figure 15:
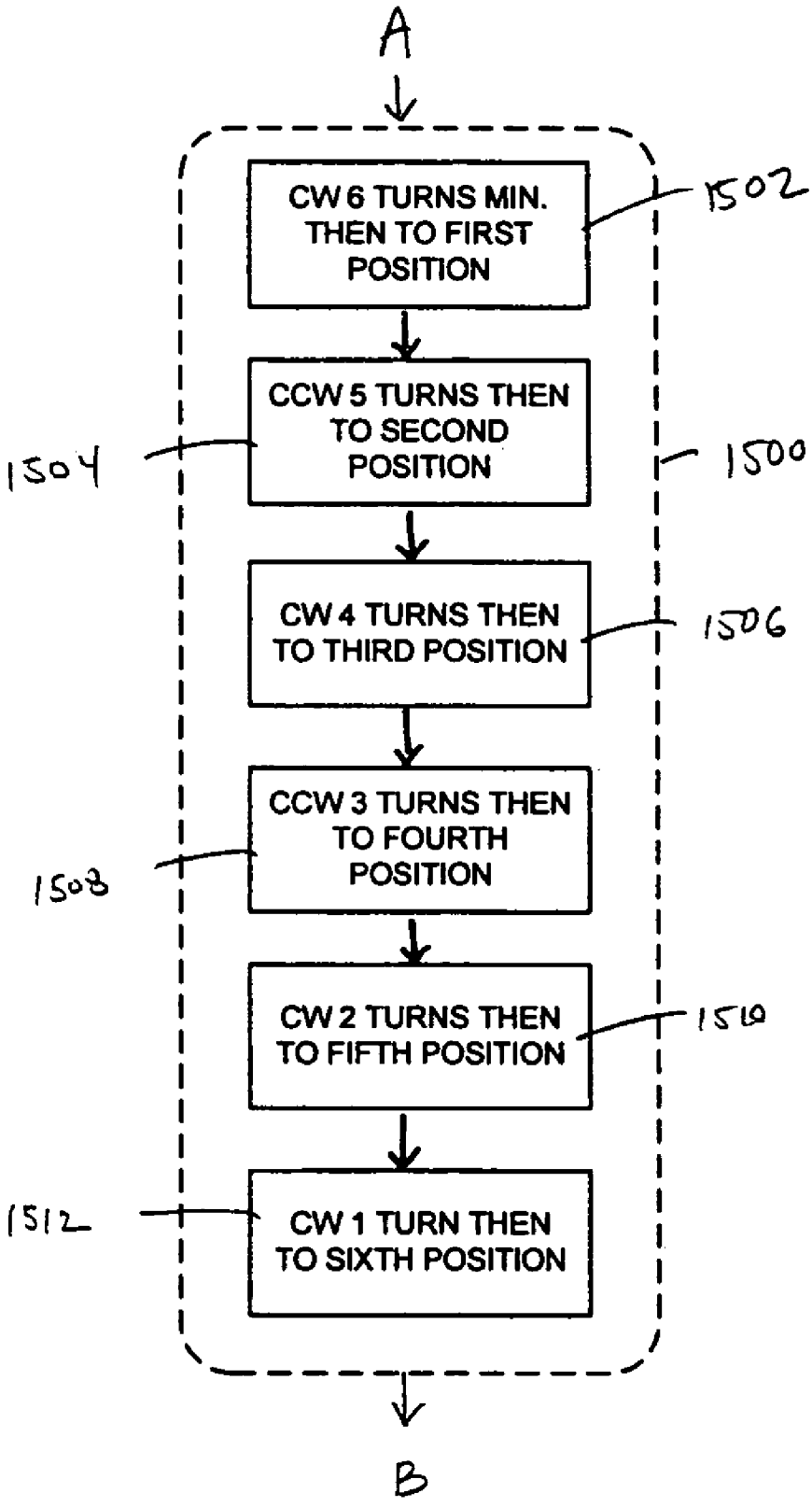
FIG. 15 is an diagrammatic flow chart depicting an example of a subroutine for aligning the disks of a combination lock having six disks, the subroutine being utilized in FIGS. 16 through 22.

FIG. 15 depicts a diagrammatic flow chart of a subroutine utilized during the opening process of certain combination locks in accordance with particular aspects of the present invention. The subroutine shown in FIG. 15 is utilized in FIGS. 16 through 22 as the "SUB-ROUTINE TO ALIGN DISCS TO OPENING POSITION," for example step 1612 of FIG. 16. In accordance with the subroutine 1500 shown in FIG. 15, and as previously discussed, a combination lock with six disks may be opened by rotating the drive shaft of the combination lock through a series of predetermined clockwise and counterclockwise rotations to align the disks.

Accordingly, the subroutine 1500 may begin at point A and proceed first to the step of rotating the drive shaft clockwise ("cw") a minimum of six turns to a first position 1502 to align the first disk. As the combination locks in question typically include no markings associated with position, the tool and combination lock may also incorporate a zeroing step, or calibration step, to align the drive shaft of the combination lock into a known position where the tool may begin the subroutine. This step, although not shown in the subroutine 1500, would typically occur prior to the step of rotating the drive shaft clockwise a minimum of six turns to a first position 1502, or may be included within that step.

Step 1502 may be followed by the step of rotating the drive shaft counterclockwise ("ccw") five turns to a second position 1504. This rotational movement serves to move all of the disks with the exception of the first disk previously aligned, and aligns the second disk into an opening position aligned with the first disk. Step 1504 may be followed by the step of rotating the drive shaft clockwise four turns to a third position 1506 to align the fourth disk. Step 1506 may then be followed by the step of rotating the drive shaft three turns in the counterclockwise direction to a fourth position 1508 to align the fourth disk. Step 1508 may be followed by the step of rotating the drive shaft two turns to a fifth position 1510 to align the fifth disk. Finally, in the sixth and last step of subroutine 1500, disk six may be aligned by following step 1510 with the step of rotating the drive shaft clockwise one turn to a sixth position 1512, thus ending the subroutine at point B with all disks aligned such that the sidebar of the combination lock may enter the disk gates when the combination lock core is rotated relative to the casing.

As previously discussed, the subroutine shown in FIG. 15 may be utilized during the processes shown in FIGS. 16 through 22 to unlock a combination lock having six disks. It will also be appreciated that other subroutines may be utilized, particularly if the number of disks is less than or greater than six.

Figure 16:
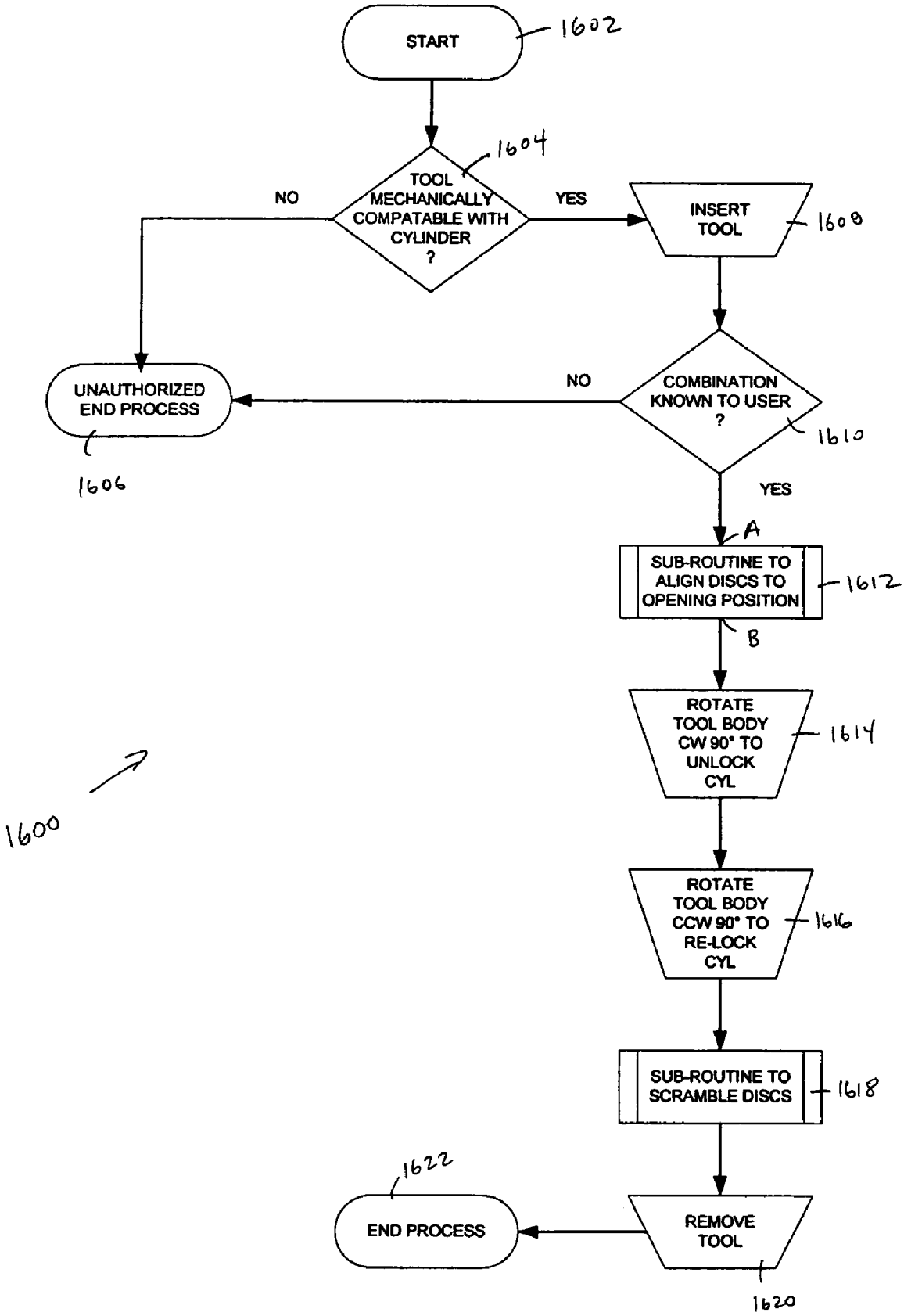
FIG. 16 is a logic diagram depicting the operation of a dumb tool in accordance with one aspect of the present invention.

FIG. 16 is a logic diagram depicting the operation of a dumb tool in accordance with one aspect of the present invention. Although there are different levels of dumb tools, it is believed that FIG. 16 depicts one of the simplest arrangements available under the present invention. In this arrangement, the operator of the tool would be charged with knowledge of the opening sequence (combination) of the combination lock, and would have to open the lock in a manual operation. In a very basic example, a finger manipulable dial with calibrated index may be associated with the lock for operation. However, because of the tight tolerances involved in the typical combination lock of the present invention, the tool preferably incorporates a step-down feature such that movement of an external dial on the tool will move the combination lock interface of the tool only a small portion of that movement. This gear reduction principle permits large obtuse movements of the human operator to be stepped down into much finer movements of the combination lock drive shaft, allowing the lock to be opened by human manipulation. Without the step down feature, only highly skilled artisans will likely be capable of the dexterity and concentration required.

Either with the step down feature or without, the tool may incorporate a revolution counting display, such that each revolution of the combination lock interface (or the finger manipulable wheel) is counted. This would eliminate the need for the user to count the revolutions manually, permitting the user to focus on the fine tuned rotation ending portions. Preferably, the display would reset back to zero following a change of direction.

The revolution counting feature is particularly suited to embodiments of the tool employing gear reduction, because the operator will not have to trouble himself/herself with knowledge of the gear reduction factor nor multiplication of the requisite number of turns of the finger manipulable wheel based on that reduction factor. For example, if the gear reduction was a factor of three, six turns of the combination lock interface of the tool would require 18 turns of the finger manipulable wheel. Five turns in the other direction would require 15 turns of the finger manipulable wheel. Once can readily see that a revolution counter associated with the tool would be welcomed by any user.

In accordance with the particular logic diagram 1600 shown in FIG. 16, a combination lock may be opened by a manual process starting with step 1602 followed by determining whether the tool is mechanically compatible with the combination lock at step 1604. In this regard, the mechanical compatibility may be determined by mating the drive shaft of the combination lock with the combination lock interface of the tool. If the combination lock interface is not compatible with the drive shaft, the tool is unauthorized to open the particular combination lock, and the process ends with step 1606. Additionally, if the tool is incapable of registration with the aperture of the front face of the combination lock, or registration tabs protruding therefrom, the tool is incapable of opening the combination lock and the process ends with step 1606.

If the tool's combination lock interface is compatible with the combination lock, then the tool may be inserted into the combination lock at step 1608. Once the combination lock interface is mated with the drive shaft in step 1608, the step of determining whether the combination is known to the user 1610 may be initiated. If the combination is not known to the user, then the tool is unauthorized for opening the lock, and the procedure ends with step 1606. If, however, the combination is known to the user, the user may mechanically rotate the combination lock interface through the requisite clockwise and counterclockwise turns in a sub-routine 1612 to align the disks of the combination lock into an opening position beginning with point A and ending with point B. The subroutine 1612 is shown as subroutine 1500 of FIG. 15. As discussed above, the tool may incorporate a gear reduction feature to allow for fine tuned manipulation, even by a human operator. The dial of the gear reduction feature of the tool preferably includes indexed markings associated with the combination of the combination lock, such that the user will have points of reference to begin and end the rotating sequences. The gear reduction mechanism may also include a revolution counter, as discussed above.

Once the disks inside of the combination lock are aligned, the tool body may be rotated, typically 90°, in step 1614 to move the latch from a locked position to unlocked position to unlock the combination lock. To relock the combination lock, step 1614 may be followed by the step of rotating the tool body in the opposite direction as step 1614 through typically a 90° excursion path in step 1616. The tool operator may then rotate the combination lock interface through a sub-routine to randomly scramble the disks in step 1618.

In this regard, the subroutine to randomly scramble the disks may include a command to rotate the combination lock interface a random number of revolutions to place the disks in a random orientation. Preferably, the total number of revolutions is at least equal to the number of disks such that each disk is picked up and spun. Most preferably, the total number of revolutions is greater than the number of disks. It will be appreciated, however, that even a partial revolution is sufficient to unalign at least one disk. In addition, it will be appreciated that the direction of rotation is irrelevant. In an alternate arrangement, the disk scrambling sequence may rotate the combination lock interface through a series of random clockwise and counterclockwise motions to place the disks into a random orientation. In this case, it is preferred that the subroutine begin with at least a number of revolutions equal to the number of disks in the lock, such that each are picked up.

Once the disks are scrambled, the tool may be removed in step 1620 and the process ended in step 1622. In lieu of the subroutine to scramble the disks 1618, the lock may be configured with a scrambler spring to achieve the same result.

Although it is preferred for security purposes that a user not know the actual opening combination sequence of the lock, such as in the above example, there are times when such application has particular merit. For example, in a manual system such as described above, the system is completely immune to certain forms of attack, such as electromagnetic pulse energy attack. In addition, a manually operated tool may find utility in emergency situations where power, particularly to a remote authority, may be unavailable. This situation also may be useful for maintenance or service personnel associated with the lock manufacturer or owner.

Figure 17:
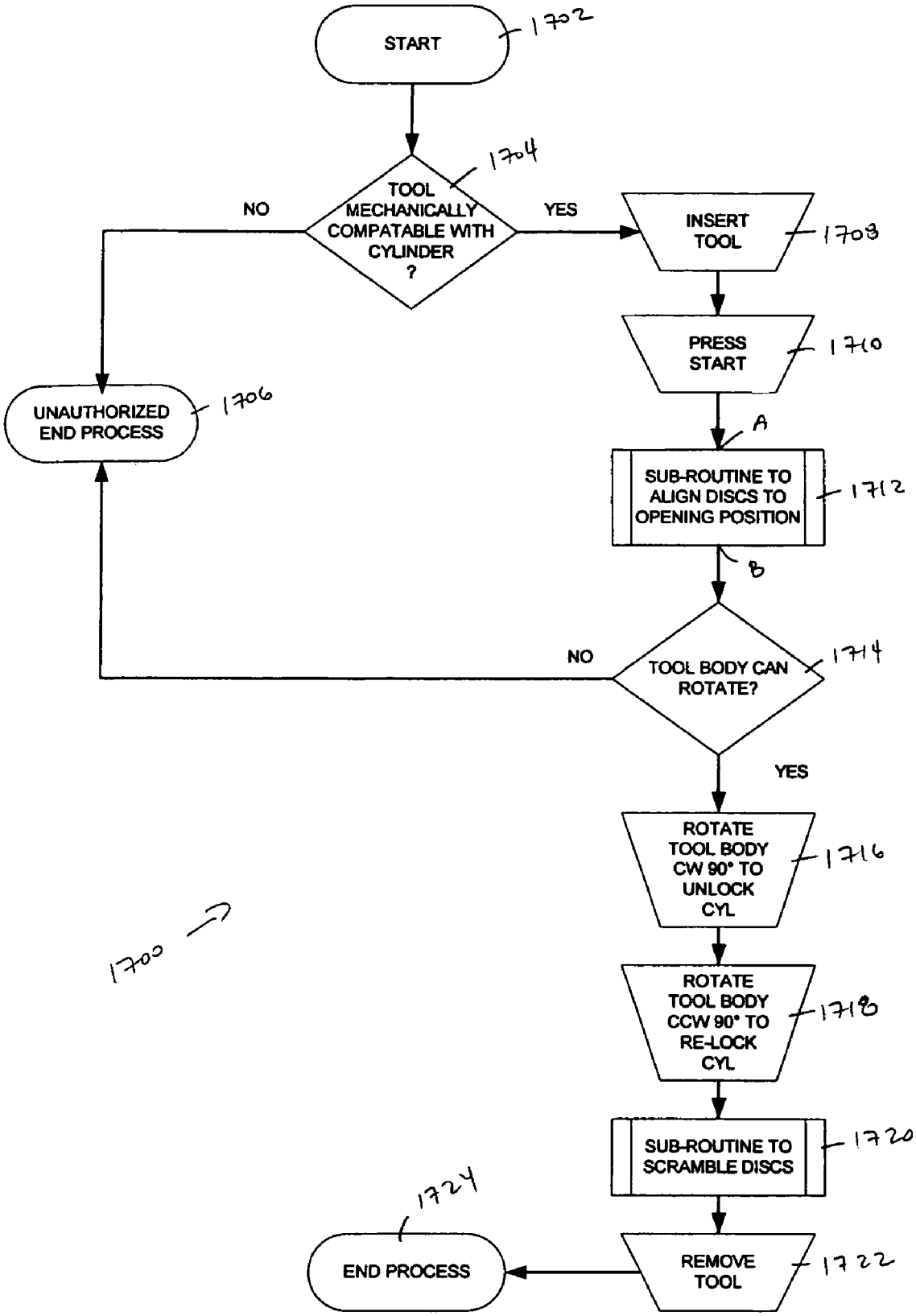
FIG. 17 is a logic diagram depicting the operation of a dumb tool in accordance with another aspect of the present invention.

In a greater level of sophistication, a dumb tool may be designed to operate only a single lock having a particular combination, or a series of locks all sharing the same particular combination. An exemplary logic diagram depicting such a tool is shown in FIG. 17 as process 1700. Process 1700 may start with step 1702 by determining whether the tool is mechanically compatible with the combination lock in step 1704. If the tool is not mechanically compatible, the process ends with step 1706. If the tool is mechanically compatible, the combination lock interface of the tool may be inserted into the lock to mate with the drive shaft of the combination lock in step 1708. Once so inserted, the operator of the tool may initiate an opening routine by pressing, for example, a start button forming a portion of the tool in step 1710. Following step 1710, the tool may go through a sub-routine to align the disks to an opening position in step 1712 beginning at point A and ending at point B of the sub-routine shown in FIG. 15. It will be appreciated that in this application, the tool incorporates only one subroutine which is particularly suited for opening only one combination. In step 1714, the operator determines whether the tool body may rotate, indicating that the disks are properly aligned for opening of the lock. If the tool body cannot rotate, then the combination entered by the tool is incorrect for the particular lock, and the process ends with step 1706. If the tool can rotate, the process may continue to step 1716 where the operator may rotate the tool body in a particular direction to unlock the combination lock. To relock the combination lock, the operator may rotate the tool in the opposite direction in step 1718. The tool may then include a sub-routine to scramble the disks to a random orientation in step 1720. Once so scrambled, the tool may be removed in step 1722 and the process ended in step 1724.

Figure 18:
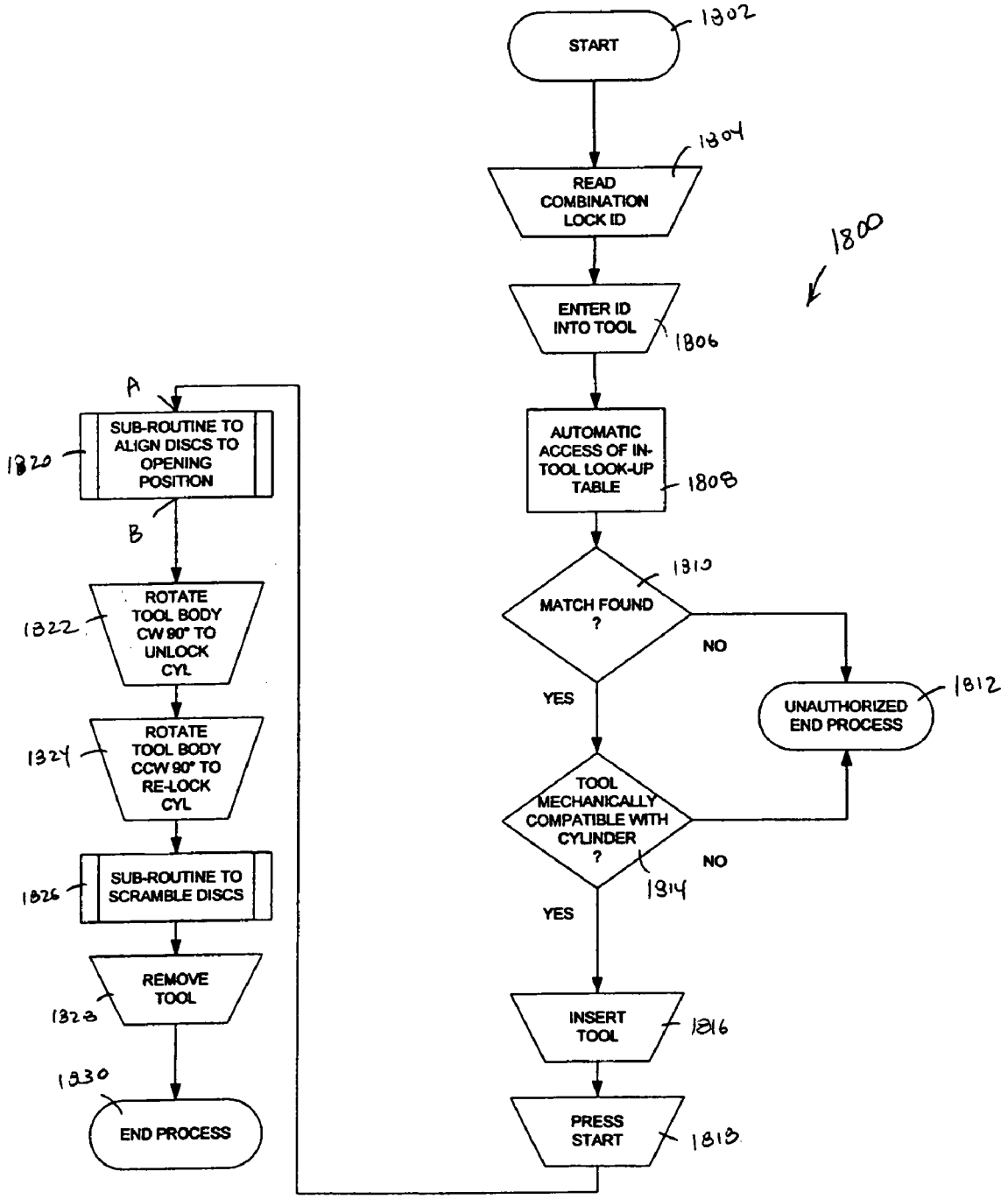
FIG. 18 is a logic diagram depicting the operation of a not-so-dumb tool in accordance with a further aspect of the present invention.

FIG. 18 depicts a logic diagram of the operation of a not-so-dumb tool in accordance with further aspects of the present invention. In accordance with the logic diagram 1800 of this exemplary not-so-dumb tool, the operator may start at step 1802. The operator may manually read an identification number off the combination lock in step 1804. In step 1806, the operator may enter the lock identification number into the tool, for example, by utilizing a keypad associated with the tool. The tool may then utilize the lock identification number in association with a look-up table embedded within the memory of the tool to determine the actual opening sequence for unlocking the lock. In step 1810, the tool determines whether a match is found. If no match is found, for example where the look-up table includes no combination for the lock identification entered, the tool is unauthorized for the particular lock, and the process ends with step 1812. If a match is found in step 1810, the process moves to step 1814 to determine whether the tool is mechanically compatible with the combination lock. If the tool is not compatible, the tool is unauthorized, and the process ends with step 1812. If the tool is compatible, the combination lock interface of the tool may be associated with the drive shaft of the lock in step 1816.

Once so associated, the operator of the tool may initiate an opening routine by pressing, for example, a start button forming a portion of the tool in step 1818. Following step 1818, the tool may go through a sub-routine to align the disks to an opening position in step 1820 beginning at point A and ending at point B of the sub-routine shown in FIG. 15. It will be appreciated that in this application, the tool utilizes the sub-routine combination found in the look-up table from step 1808. In step 1822, the operator rotates the tool to rotate the latch of the combination lock to an open position. To relock the combination lock, the operator may rotate the tool in the opposite direction in step 1824. The tool may then include a sub-routine to scramble the disks to a random orientation in step 1826. Once so scrambled, the tool may be removed in step 1828 and the process ended in step 1830.

Figure 19:
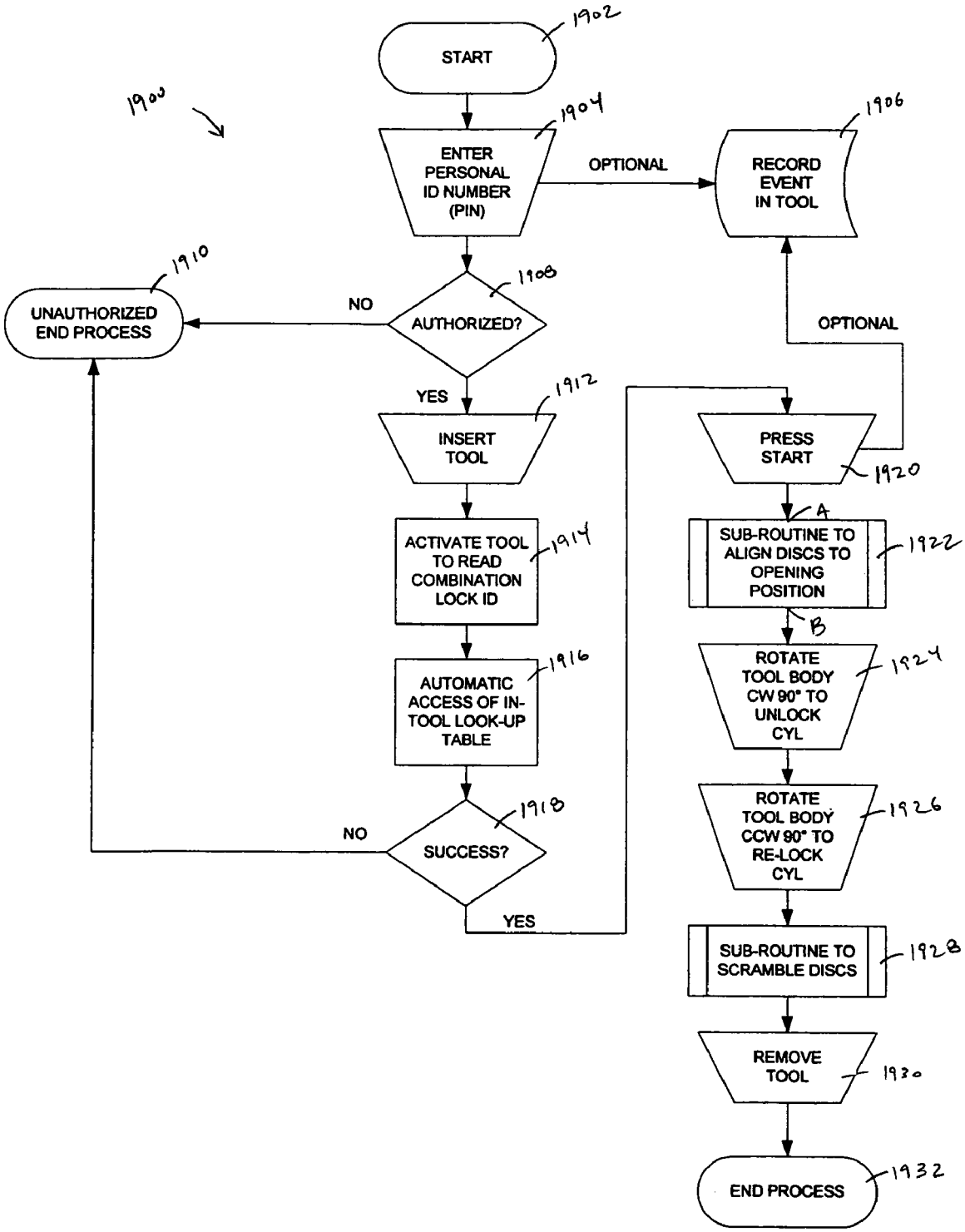
FIG. 19 is a logic diagram depicting the operation of a not-so-dumb tool in accordance with an additional aspect of the present invention.

FIG. 19 depicts a logic diagram of the operation of a not-so-dumb tool in accordance with an additional aspect of the present invention. In accordance with FIG. 19, a logic diagram 1900 may start at step 1902. At step 1904, a user may enter a personal identification number associated with that user into a keypad forming a portion of the tool. The tool may optionally record the personal identification number into an internal memory in step 1906. In this step, the tool may also incorporate additional recorded features, such as a time stamp and location identification (for example by way of global positioning satellites). In step 1908, the tool determines whether the user is authorized to operate the particular tool by comparing the user's personal identification number with a look-up table. If the user is not authorized, the process ends with step 1910. If the user is authorized, the process continues to step 1912 where the combination lock interface of the tool may be associated with the drive shaft of the lock. In step 1914, the tool may be activated to read the lock identification. This may be achieved by RFID, a mote, a CMB, optical bar code, magnetic strip, or similar medium. In step 1916, the tool may utilize a look-up table stored within the tool's memory to associate the lock identification with a combination for that particular lock. Step 1918 determines whether a combination can be found. If no combination can be found, the process ends with step 1910. If a combination is found, the user may initiate opening of the lock by pressing a start button in step 1920. Optionally, this event may be recorded in the tool at step 1906.

Following step 1920, the tool may go through a sub-routine to align the disks to an opening position in step 1922 beginning at point A and ending at point B of the sub-routine shown in FIG. 15. It will be appreciated that in this application, the tool utilizes the sub-routine combination found in the look-up table from step 1916. In step 1924, the operator rotates the tool to rotate the latch of the combination lock to an open position. To relock the combination lock, the operator may rotate the tool in the opposite direction in step 1926. The tool may then include a sub-routine to scramble the disks to a random orientation in step 1928. Once so scrambled, the tool may be removed in step 1930 and the process ended in step 1932.

Figure 20:
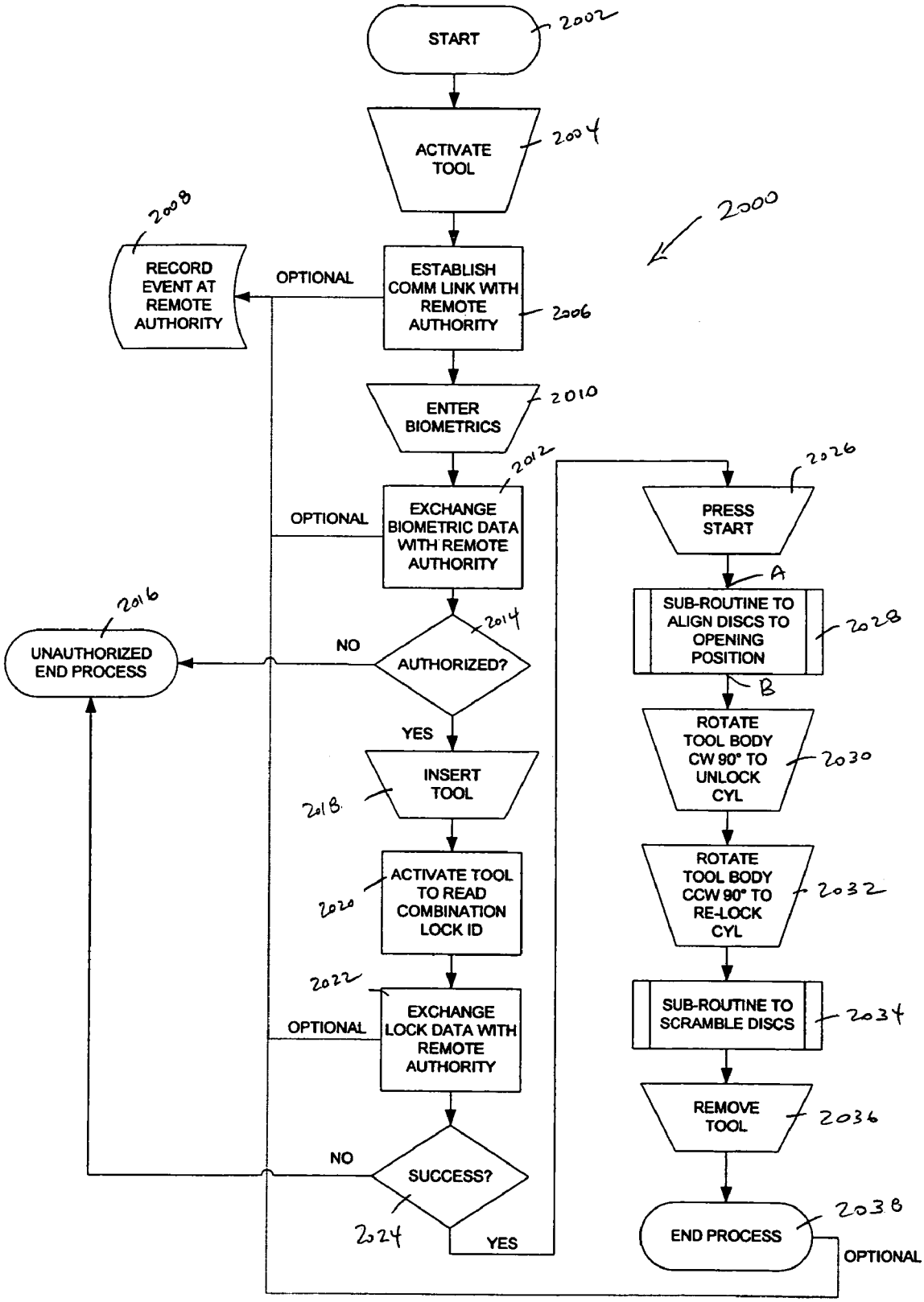
FIG. 20 is a logic diagram of a smart tool in accordance with certain aspects of the present invention.

FIG. 20 depicts a logic diagram 2000 of a smart tool in accordance with certain aspects of the present invention. As previously discussed, the smart tool builds on the teachings of the not so smart tool and adds the ability to communicate with a remote authority. As shown in FIG. 20, the logic diagram may start at step 2002 and proceed to step 2004 where a user activates the tool. Alternately, the tool may be self-activated in a subsequent step, such as the subsequent step of inserting the tool into the lock 2018. In step 2006, the tool may establish a communication link with a remote authority. Optionally, this event may be recorded at the remote authority in step 2008. The remote authority may record certain data associated with the event, such as the time of the event and physical location of the tool, if the tool is provided with location identification means.

In step 2010, a user may enter biometric data into the tool for authorization. This biometric data may include fingerprints, retinal scanning, voice sampling, or the like. In step 2012, the biometric data may be exchanged with the remote authority. Optionally, this event may be recorded at the remote authority in step 2008. Authorization of the user is conducted in step 2014. If the user is not authorized by the remote authority, the process ends with step 2016 and the tool may be locked-out from further use until correct biometrics are entered. If the user is authorized, the tool may be associated with the lock in step 2018.

Part of the authorization process may include video information sent from the tool to the remote authority. Such video surveillance may be utilized to observe whether the tool operator, although providing the requisite biometric data, pass code, or other authorization, is under duress or force.

Once the tool is associated with the lock in step 2018, the tool may be activated to read the combination lock identification in step 2020. In step 2022, the lock combination identification read by the tool may be exchanged with the remote authority. In step 2024, the remote authority may determine whether a combination for that particular lock identification is known. If the lock opening combination is known, the remote authority may provide the proper opening sequence for the lock to the tool based on a look-up table available to the remote authority, also in step 2024. If the combination is not known, the process ends with step 2016.

Following step 2024, the user may begin the actual lock opening process by, for example, pressing a start button located on the tool in step 2026. The tool may then go through a sub-routine to align the disks to an opening position in step 2028 beginning at point A and ending at point B of the sub-routine shown in FIG. 15. It will be appreciated that in this application, the tool utilizes the sub-routine combination found in the look-up table from the remote authority. In step 2030, the operator rotates the tool to rotate the latch of the combination lock to an open position. To relock the combination lock, the operator may rotate the tool in the opposite direction in step 2032. The tool may then include a sub-routine to scramble the disks to a random orientation in step 2034. Once so scrambled, the tool may be removed in step 2036 and the process ended in step 2038. Optionally, this ending point may be recorded at the remote authority in step 2008.

Figure 21:
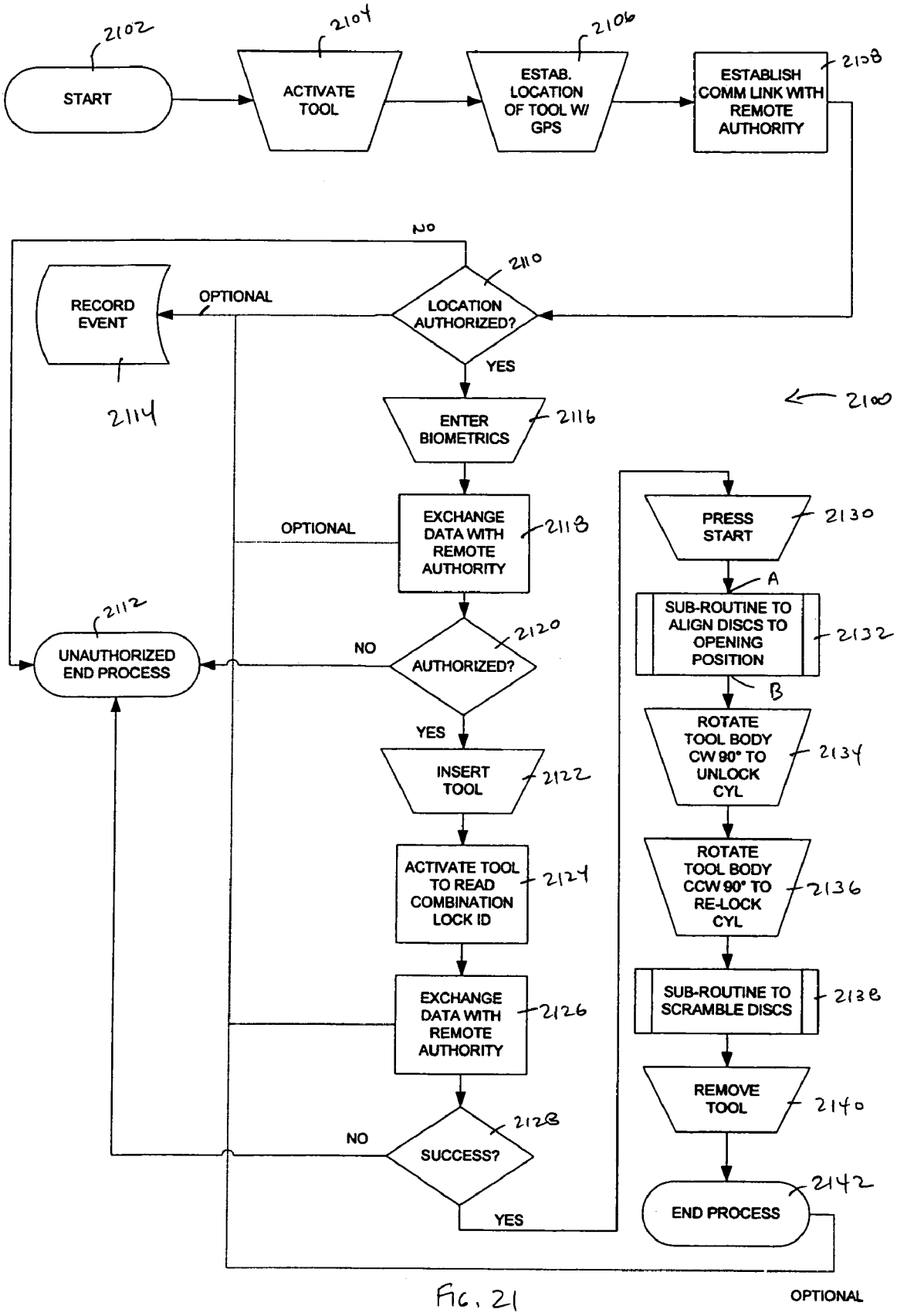
FIG. 21 is a logic diagram of a smart tool in accordance with further aspects of the present invention.

FIG. 21 depicts a logic diagram 2100 of a smart tool in accordance with certain aspects of the present invention. This particular smart tool operates in a manner similar to that of the tool identified in association with logic diagram of FIG. 20, but includes additional features.

As shown in FIG. 21, the logic diagram may start at step 2102 and proceed to step 2104 where a user activates the tool. In step 2106, the tool may establish a location by location detection means, such as GPS. Once the tool identifies its location, the tool may establish a link with a remote authority in step 2108. The remote authority may thereafter determine whether the tool is permitted to be activated in that particular location in step 2110. If the tool is not permitted by the remote authority to operate at its location, the process ends with step 2112. If the tool is permitted to operate, then the process may proceed to step 2116 where biometric data from the user is collected by the tool. Optionally, the authorization process of step 2110 may be recorded by the tool itself or preferably by the remote authority in step 2114.

In step 2116, a user may enter biometric data into the tool for authorization. This biometric data may include fingerprints, retinal scanning, voice sampling, or the like. In step 2118, the biometric data may be exchanged with the remote authority. Optionally, this event may be recorded at the remote authority in step 2114. Authorization of the user is conducted in step 2120. If the user is not authorized by the remote authority, the process ends with step 2112 and the tool may be locked-out from further use until correct biometrics are entered. If the user is authorized, the tool may be associated with the lock in step 2122. Once the tool is associated with the lock in step 2122, the tool may be activated to read the combination lock identification in step 2124.

In step 2126, the lock combination identification read by the tool may be exchanged with the remote authority. In step 2128, the remote authority may determine whether a combination for that particular lock identification is known. If the lock opening combination is known, the remote authority may provide the proper opening sequence for the lock to the tool based on a look-up table available to the remote authority, also in step 2128. If the combination is not known, the process ends with step 2112.

Following step 2128, the user may begin the actual lock opening process by, for example, pressing a start button located on the tool in step 2130. The tool may then go through a sub-routine to align the disks to an opening position in step 2132 beginning at point A and ending at point B of the sub-routine shown in FIG. 15. It will be appreciated that in this application, the tool utilizes the sub-routine combination found in the look-up table from the remote authority. In step 2134, the operator rotates the tool to rotate the latch of the combination lock to an open position. To relock the combination lock, the operator may rotate the tool in the opposite direction in step 2136. The tool may then include a sub-routine to scramble the disks to a random orientation in step 2138. Once so scrambled, the tool may be removed in step 2140 and the process ended in step 2142. Optionally, this ending point may be recorded at the remote authority in step 2114.

Figure 22:
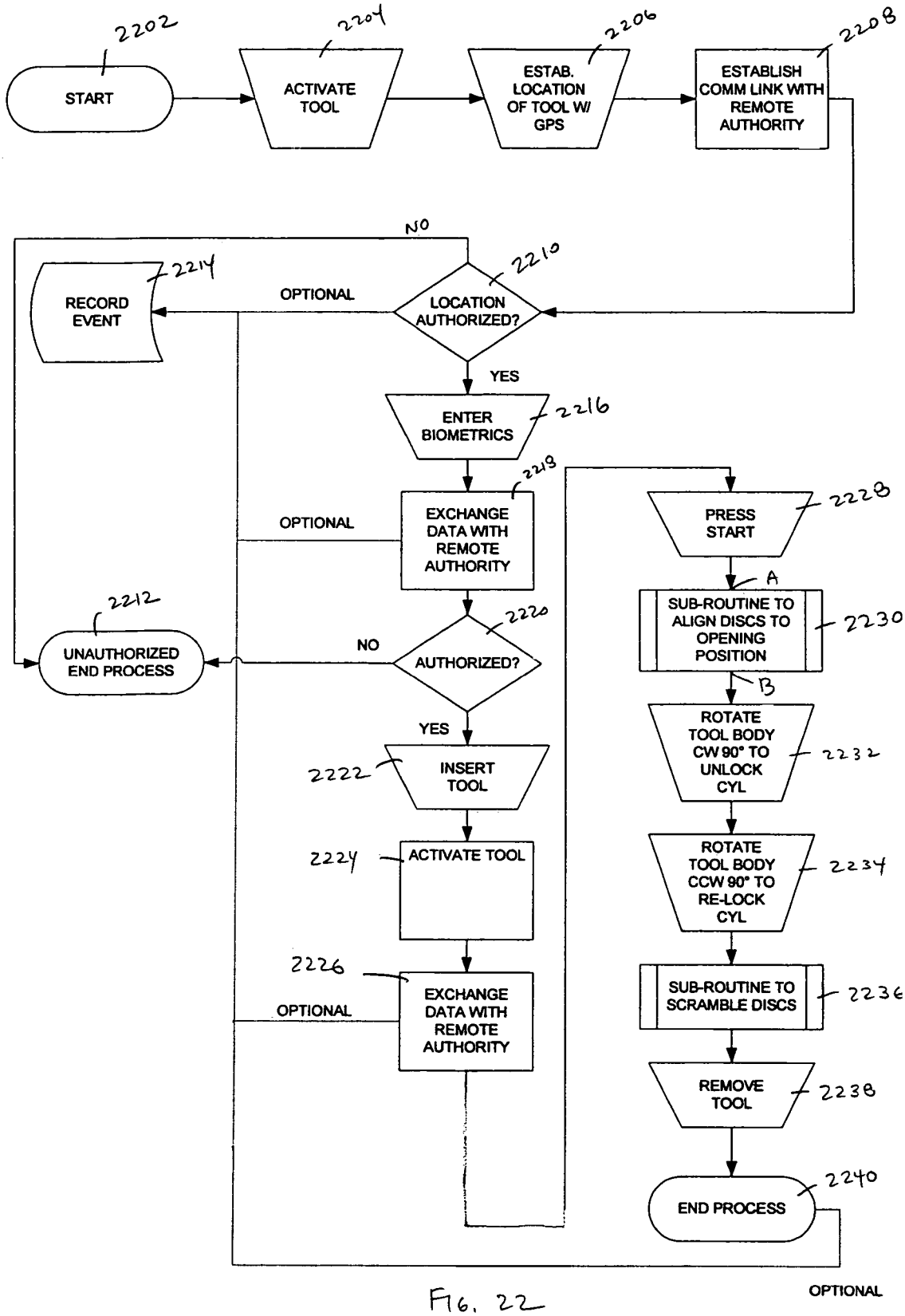
FIG. 22 is a logic diagram of a smart tool in accordance with additional aspects of the present invention; and, FIGS. 23*a* through 23*g* depict steps in a method in accordance with one aspect of the present invention for determining the combination of an assembled lock core.

In a final example of a logic diagram which may be associated with a smart tool in accordance with aspects of the present invention, FIG. 22 depicts a logic diagram 2200 of a smart tool building on the teachings of the logic diagram shown in FIG. 21. In this regard, the logic diagram shown in FIG. 22 differs from that shown in FIG. 21 in that the location of the tool is utilized in FIG. 22 to determine the opening combination for the lock, rather than an identification number associated with the lock. This particular arrangement may find use in a variety of fields. For example, a parking authority may have three parking lots within its jurisdiction. Each parking spot may have a meter for patrons to pay into during times in which they park. Rather than having a single combination for each of the meters, the authority may arrange the meters such that the meters of any given lot have the same combination. In this regard, there will be three different combinations, each one associated with a single lot.

As will be discussed, in the logic diagram shown in FIG. 22, a single tool may be utilized to open each of the parking meters. The tool may obtain the correct combination for the meters of a given lot based on its geographic location of being within the particular lot.

Accordingly, the logic diagram for the smart tool shown in FIG. 22 may start at step 2202 and proceed to step 2204 where a user activates the tool. In step 2206, the tool may establish a location by location detection means, such as GPS. Once the tool identifies its location, the tool may establish a link with a remote authority in step 2208. The remote authority may thereafter determine whether the tool is permitted to be activated in that particular location in step 2210. If the tool is not permitted by the remote authority to operate at its location, the process ends with step 2212. If the tool is permitted to operate, then the process may proceed to step 2216 where biometric data from the user is collected by the tool. Optionally, the authorization process of step 2210 may be recorded by the tool itself or preferably by the remote authority in step 2214.

In step 2216, a user may enter biometric data into the tool for authorization. This biometric data may include fingerprints, retinal scanning, voice sampling, or the like. In step 2218, the biometric data may be exchanged with the remote authority. Optionally, this event may be recorded at the remote authority in step 2214. Authorization of the user is conducted in step 2220. If the user is not authorized by the remote authority, the process ends with step 2212 and the tool may be locked-out from further use until correct biometrics are entered. If the user is authorized, the tool may be associated with the lock in step 2222. Once the tool is associated with the lock in step 2222, the tool may be activated with step 2224 to collect the combination lock data from the remote authority in step 2226. Optionally, this event may be recorded by the remote authority in step 2214. It will be appreciated that, in an alternate configuration, the tool may have the particular combinations embedded in its memory, such that communication with the remote authority for the particular combination is not necessary.

Once the tool has uploaded the combination data from the remote authority in step 2226 (or has obtained the combination from its memory), the user may begin the actual lock opening process by, for example, pressing a start button located on the tool in step 2228. The tool may then go through a sub-routine to align the disks to an opening position in step 2230 beginning at point A and ending at point B of the sub-routine shown in FIG. 15. It will be appreciated that in this application, the tool utilizes the sub-routine combination found in the look-up table from the remote authority (or optionally from within the tool). In step 2232, the operator rotates the tool to rotate the latch of the combination lock to an open position. To relock the combination lock, the operator may rotate the tool in the opposite direction in step 2234. The tool may then include a sub-routine to scramble the disks to a random orientation in step 2236. Once so scrambled, the tool may be removed in step 2238 and the process ended in step 2240. Optionally, this ending point may be recorded at the remote authority in step 2214.

These examples of the types and operation of tools contemplated are not intended to be limiting. Rather, they are exemplary of the features of particular tools and systems of tools and locks contemplated by the inventors herein. Various combinations of the features shown and described may be incorporated into tools and systems flowing directly from the disclosure herein, as the features may be used interchangeably.

In accordance with further aspects of the invention, a combination lock disk core, such as disk core 200 shown in FIG. 6, may manufactured and fully assembled in a predetermined arrangement such that the opening combination of the disk core is known. In other manufacturing techniques, the disk core 200 may be assembled in a random arrangement without the opening combination of the disk core being known. FIGS. 23*a* through 23*g* illustrate one technique for determining the correct opening combination of a disk core 2300 assembled at random.

Figure 23A:
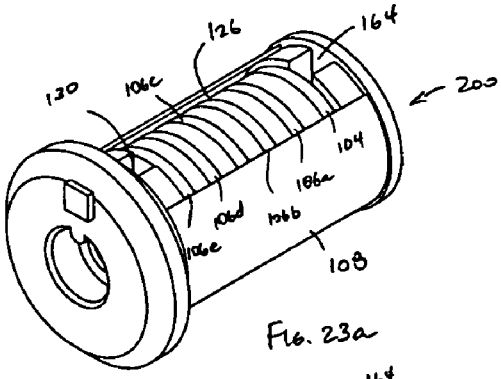

As shown in FIG. 23*a*, a disk core 200 may be assembled such that none of the gates 118 are visible through the open top area 126 of drive cylinder 108. Although not shown, it will be appreciated that some of the gates may be visible, depending on the random pattern in which they are installed. In any event, the front cap gate 130 and side bar gate 164 may be visible, and may be in alignment.

A video camera or position indication sensor may then record a series of movements of the disks 104, 106*a* through 106*e*, which places the gates 118 of each disk 104, 106*a* through 106*e* into alignment with front cap gate 130 and side bar gate 164. The video camera or position indication sensor may work off of known technology and may base their reading off, for example, gate edge recognition or a score line in the center of the gate. The alternating angular movements may then be saved as the opening combination for that particular lock.

In this regard, assuming that six disks are utilized such as in disk core 200, the drive disk 104 may be rotated in a predetermined direction, for example in a clockwise direction to a given reference point. This may be considered the opening value reference point, and can be measured against, for example, a tab 136 extending into the aperture 134 of the front face 132.

From this reference point, the drive disk 104 may be rotated at least six times in a particular direction, which for purposes of description may be the clockwise direction. Rotation may thereafter cease when the disks have all been "picked-up," and the gate 118 of disk 106*e* is aligned with the front cap gate 130 and the side bar gate 164. The angle of rotation may then be recorded as the first reference in the combination for that particular lock. A disk core 200 with gate 118 of disk 106*e* properly aligned is shown in FIG. 23*b*.

Figure 23E:
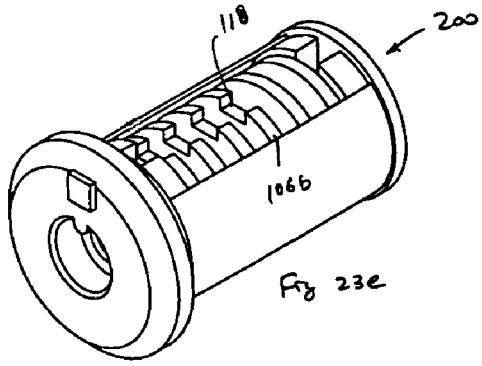
Figure 23B:
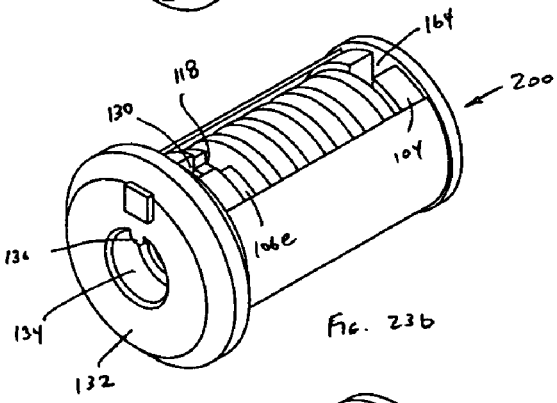
Figure 23F:
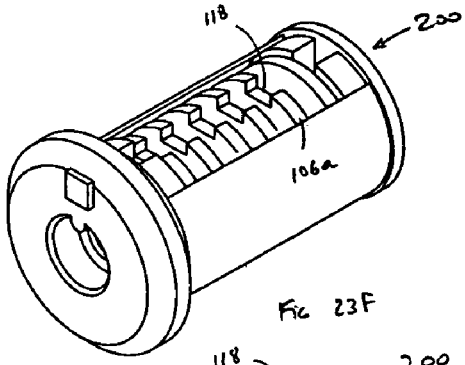
Figure 23C:
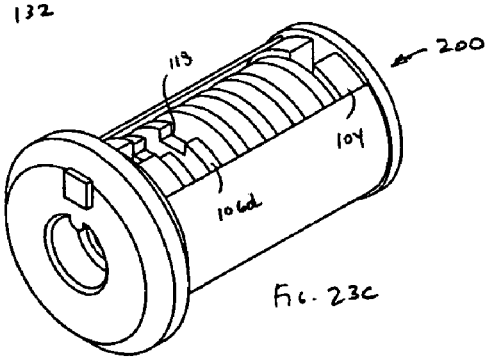

The drive disk 104 may then be rotated in the opposite direction, here the counterclockwise direction, until the gate 118 of disk 106*d* is aligned with the gate 118 of disk 106*e*, as shown in FIG. 23*c*. The angle of rotation required for this to occur may then be recorded as the second reference in the combination for that particular lock.

Figure 23G:
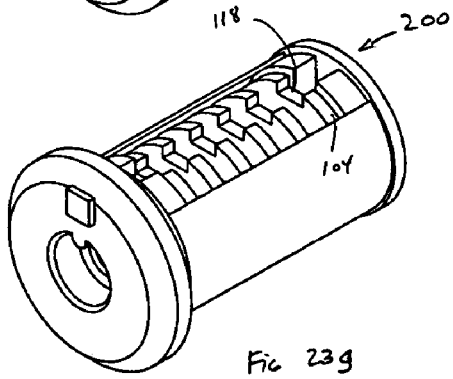
Figure 23D:
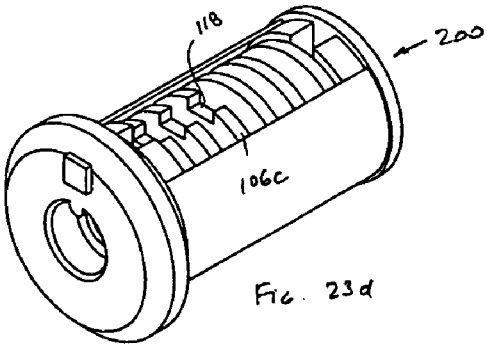

This process may be repeated for disk 106*c*, as shown in FIG. 23*d*, disk 106*b* as shown in FIG. 23*e*, disk 106*a* as shown in FIG. 23*f*, and finally drive disk 104 as shown in FIG. 23*g*. Once all of the alternating rotations have been completed and recorded, the correct opening sequence (combination) for that particular disk core 200 will be known.

In accordance with other aspects of the present invention, additional security features against illicit operation may be incorporated. In accordance with one aspect, combination locks having multiple disks may include disks manufactured from different materials. One popular mode of illicitly opening a combination lock is by x-raying the lock to identify the location of the disk gates, and then manipulating the disks until they are aligned. However, certain materials are radio transparent and cannot be viewed with x-ray technology. A combination lock may therefore, include disks of such materials, either exclusively or in combination with disks of other materials. Examples of disks which are radio transparent are ceramic, glass, and plastic.

Other attack modes focus on the density of disk material. To counter these attack modes, disks of different densities may be utilized. For example, plastic disks are typically much less dense than metallic disks, such as brass, stainless steel, aluminum, titanium, iron, or the like.

Another common attack mode is drilling through the disks to open up a false gate. To prevent this form of attack, one or more disks may be made of material that will shatter when drilled. Such materials may include glass or ceramic.

As the disks rotate within the lock, malfeasants may utilize high tech listening devices to listen to the moving parts contacting each other to identify the opening sequence. By utilizing disks of different materials, the sounds may change making listening less effective.

Perhaps the most common attack method is simply rotating the disk cylinder and feeling for the gate opening. Because of the sheer number of disks proposed in certain aspects of the invention, this is very difficult if not impossible. However, the attempt may be further frustrated by providing disks of different materials as the coefficient of friction for each material may be different, changing the feel from disk to disk.

It will further be appreciated, that no matter the material utilized for each disk, another feature of certain aspects of the present invention is that the malfeasant will not know the number of disks that are in the lock. Thus, the malfeasant will not know how many gates are to be found. This further frustrates attempts to open the locks illicitly.

In another attack method, malfeasants may attempt to drill the face of a lock to drill through the side bar. Without the side bar in place, the lock may be easily opened. Traditional locks of the same type from one manufacture incorporate a side bar at a consistent position. Thus, if a malfeasant were to obtain one lock of a particular type from a manufacture, he may be able to identify the location of the side bar for all locks of the same type. In the present invention, the location of the side bar may be varied such that it may be located at any location around the 360° face of the lock. For example, referring to FIG. 1 where the side bar 114 is located at the uppermost portion of the lock cylinder, it will be appreciated that the side bar may be moved to a side portion or bottom portion. In such case, the notch 120 of the casing 102 should be aligned with the side bar 114. It will be appreciated that random placement of the side bar may frustrate a would be attacker, by at least causing the illicit and destructive entry to be slowed.

In accordance with yet another security feature, a lock cylinder may be used only a single time in a particular application, or may be rotated through an application with different cylinders. For example, particularly with vaults or safes, a common method of attacking the container lock is to record the movement of the disks in the lock during an authorized entrance. Once the recording is made, a sophisticated malfeasant can analyze the recording to determine the opening combination. Even attempts to interfere with the recording, for instance by adding outside sound sources, can be filtered out.

However, if a particular cylinder is only used once with that vault or safe, it will not matter that the malfeasant is aware of that particular combination. Once the lock is opened, the cylinder can be removed and replaced with another having a different opening combination. The original cylinder can either be placed in a pool for reuse in a different vault or safe or destroyed, depending on the security level required by the application.

Many of the disclosures of the present invention, particularly features of the tools, although being described in association with tools and locks also disclosed herein, may be utilized in conjunction with existing locks and tools. For example, location detection and recording of a lock-opening event may be incorporated into existing locks, such as Mul-T-Lock®'s Interactive® CLIQ® lock, Abloy's® SmartDisc lock, Medeco's® NEXGEN® locks, Videx's® CiberLock lock, or the like. Likewise, biometric authorization or time dependent use may also be incorporated. Although not specifically listed, it will be appreciated to one skilled in the art that many of the features disclosed herein may be utilized effectively in association with the teachings of these known devices.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A tool for opening a combination lock, said tool comprising:

a tool body;

a motor inside the tool body, having a shaft that extends from the tool body and that is adapted to be rotated relative to the tool body in lock opening sequences of alternating clockwise and counterclockwise rotations when the motor is operated;

a motor controller in communication with the motor and adapted to control operation of said motor;

a lock interface formed by a notch in an end of the shaft which is outside the tool body;

a single registration mechanism for rotating a portion of the combination lock and being fixed to and extending from the tool body in parallel with the shaft, wherein the registration mechanism does not rotate relative to the tool body; and, a user interface, said user interface communicating with said motor controller.

2. The tool of claim 1, wherein said tool is operable to receive a lock identification number entered into said user interface.

3. The tool of claim 2, further including a memory module containing cross-references between the lock identification number and the lock opening sequence.

4. The tool of claim 1, further including a biometric data reception port.

5. The tool of claim 4, wherein said tool is only operable upon entry of preauthorized biometric data into said biometric data reception port.

6. The tool of claim 1, further including a location detection element, said location detection element adapted to identify the geographic location of said tool.

7. The tool of claim 6, wherein said tool is operable within certain geographic locations identified by said location detection element.

8. The tool of claim 6, wherein said lock interface is responsive to said location detection element so as to select said opening sequences based on the geographic location of said tool.

9. The tool of claim 1, wherein said tool is operable only upon a proper input into said user interface.

10. The tool of claim 9, wherein said proper input is one of an identification signal, biometric data of a user, or a user identification number.

11. A method of opening a combination lock with a tool, the tool having a motor with a shaft having a notched end that extends from the tool and a single registration mechanism fixed to the tool and extending from the tool in parallel with the shaft, and the combination lock having a body with an interface and an opening sequence consisting of clockwise and counterclockwise rotations of a non finger manipulable lock opening component, said method comprising:

mating the notched end of the shaft of the tool with the non-finger manipulable lock opening component of the combination lock;

mating the single registration mechanism of the tool with the interface of the body of the combination lock that provides the tool with a known position with regard to the body of the combination lock;

electrically operating the motor in the tool to rotate the non finger manipulable lock opening component through a series of clockwise and counterclockwise rotations corresponding to the opening sequence to unlock the lock.

12. The method of claim 11, wherein the lock further comprises a latch, the method further comprising the step of: rotating the tool to unlatch the latch.

13. The method of claim 11, further comprising the step of: reading a lock identification sequence from the lock.

14. The method of claim 13, further comprising the step of: associating the lock identification sequence with the lock opening sequence.

15. The method of claim 14, wherein the step of associating is conducted at a remote authority.

16. The method of claim 11, further comprising the step of: recording the opening event.

17. The method of claim 11, wherein the step of rotating may only be conducted following authorization.

18. The method of claim 17, wherein authorization is based on factors selected from the group consisting of: biometric data of a user, personal identification number of a user, a lock identification sequence, temporal considerations, geographic location of the tool at time of operation, approval of a remote authority, and acceptance of a signal.

19. The method of claim 18, wherein the authorization is obtained from a remote authority.

* * * * *